US006471314B2

(12) United States Patent
Doi

(10) Patent No.: US 6,471,314 B2
(45) Date of Patent: Oct. 29, 2002

(54) PRINTING CONTROL METHOD, PRINTING DEVICE, PRINTING CONTROL DEVICE AND STORAGE MEDIUM STORING PRINTING CONTROL PROGRAM

(75) Inventor: Hiroshi Doi, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/729,589

(22) Filed: Dec. 4, 2000

(65) Prior Publication Data

US 2001/0003457 A1 Jun. 14, 2001

(30) Foreign Application Priority Data

Dec. 3, 1999 (JP) ..... 11-345400

(51) Int. Cl.[7] ..... B41J 3/00; B41J 29/38; B41J 29/393

(52) U.S. Cl. ..... 347/5; 347/2; 347/19

(58) Field of Search ..... 347/5, 7, 1, 2, 347/14, 19

(56) References Cited

U.S. PATENT DOCUMENTS 5,911,526 A * 6/1999 Watanabe ..... 347/19

FOREIGN PATENT DOCUMENTS

| | | | |
|---|---|---|---|
| JP | 4-74683 | 3/1992 | |
| JP | 4-182180 | 6/1992 | |
| JP | 8-118675 | 5/1996 | |
| JP | 9-156125 | 6/1997 | |
| JP | 9-297666 | 11/1997 | |
| JP | 10-58667 | 3/1998 | |
| JP | 10-315501 | 12/1998 | |
| JP | 11-157174 | 6/1999 | |
| JP | 411157174 A * | 6/1999 | ..... 347/5 |
| JP | 11-198474 | 7/1999 | |
| JP | 11-320910 | 11/1999 | |

* cited by examiner

*Primary Examiner*—John Barlow
*Assistant Examiner*—An H. Do
(74) *Attorney, Agent, or Firm*—Dickstein, Shapiro, Morin & Oshinsky, L.L.P.

(57) ABSTRACT

A method of cost-effective printing control for printing a variety of documents or images in color. An operator is notified whether printing is enabled as well as of the residual amounts of two or more printing agents. Printing data, including both character printing and graphics commands, is created for a given object to be printed. The amounts of each printing agent required for a given object is predicted and the object is printing if the quantities of all printing agents exceed their respective predicted amounts. No printing occurs and the printing operator is alerted if the amount of any one printing agent is below the amount predicted for that agent.

24 Claims, 10 Drawing Sheets

FIG.11

"not yet scheduled"

"Ink is not sufficient for printing object D.
Printing of printing object D and downward is not done".

| order of printing execution | printing object | amount of each of ink predicted to be consumed | | | residual amount of each of ink being left after printing each of printing objects | | | total residual amount of all kinds of inks |
|---|---|---|---|---|---|---|---|---|
| | | C | M | Y | C | M | Y | |
| 1 | A | 5 | 7 | 7 | 15 | 13 | 13 | 41 |
| 2 | B | 7 | 4 | 6 | 8 | 9 | 7 | 24 |
| 3 | C | 2 | 5 | 4 | 6 | 4 | 3 | 13 |
| — | D | 8 | 9 | 7 | -2 | -5 | -4 | shortage |

PRINT SCHEDULING CANCEL

FIG.12

"already scheduled"

"Ink is not sufficient for printing object C.
Printing of printing object C and downward is not done".

| order of printing execution | printing object | amount of each of ink predicted to be consumed | | | residual amount of each of ink being left after printing each of printing objects | | | total residual amount of all kinds of inks |
|---|---|---|---|---|---|---|---|---|
| | | C | M | Y | C | M | Y | |
| 1 | A | 5 | 7 | 7 | 15 | 13 | 13 | 41 |
| 2 | B | 7 | 4 | 6 | 8 | 9 | 7 | 24 |
| 3 | C | 8 | 9 | 7 | 0 | 0 | 0 | 0 |
| — | D | 2 | 5 | 4 | -2 | -5 | -4 | shortage |

PRINT SCHEDULING CANCEL

*FIG.13*

*"not yet scheduled"*

*"All printing objects can be printed."*

| order of printing execution | printing object | amount of each of ink predicted to be consumed | | | residual amount of each of ink being left after printing each of printing objects | | | total residual amount of all kinds of ink |
|---|---|---|---|---|---|---|---|---|
| | | C | M | Y | C | M | Y | |
| 1 | C | 2 | 5 | 4 | 98 | 95 | 96 | 289 |

PRINT SCHEDULING CANCEL

PRINTING CONTROL METHOD, PRINTING DEVICE, PRINTING CONTROL DEVICE AND STORAGE MEDIUM STORING PRINTING CONTROL PROGRAM

BACKGROUND OF THE INVENTION

1. Field of the Invention

The present invention relates to a printing control method, a printing device, a printing control device and a storage medium storing a program for the printing control method and more particularly to the printing control method to control printing operations based on residual amounts of printing agents, which can be applied to printing devices such as a xerographic copying machine, facsimile, printer or a like, adapted to print, using printing agents such as ink, toner or a like, an object to be printed (hereafter referred to as a "printing object") containing a document, image or a like, on a printing medium such as paper, OHP (Overhead Projector) films, and to the printing device to do printing in accordance with the printing control method, the printing control device to implement the printing control method and the storage medium storing the program for the printing control method.

The present application claims priority of Japanese Patent Application No. Hei 11-345400 filed on Dec. 3, 1999, which is hereby incorporated by reference.

2. Description of the Related Art

As printing devices to print, for example, a xerographic copying machine, facsimile, printer or a like are available using printing agents such as ink, toner or a like, a printing object containing a document, image or a like, on a printing medium such as paper, OHP films or a like. Since, in operations of these printing devices, consumables including printing agents, printing medium or a like are consumed every time printing objects containing the document, image or the like on the printing medium are printed, in order to prevent such consumables from running out in a very middle course of printing or in order to use printing agents with minimum wastage, various conventional technologies are disclosed including one adapted to inform an operator of a disabled state of printing and residual amounts of such consumables, another adapted to control printing based on residual amounts of such consumables, or a like.

One example of such technologies is disclosed in Japanese Patent Application Laid-open No. Hei 4-182180 in which, in a thermal transfer label printer to thermally transfer ink on an ink ribbon to printing paper by driving a thermal head based on contents to be printed, the printing paper and ink ribbon are transported by a transporting amount preset in accordance with a length of a label and with intervals between labels every time labels are issued and whether the issuance of a specified number of labels instructed to be issued is possible or not is judged based on a residual length of the ink ribbon and on transported amounts of the ink ribbon, and if the issuance is impossible, an instruction for prohibiting a start of the issuance of the label is provided or a state that the label cannot be issued is informed to an operator (this being referred in this application to as "first conventional technology").

Another example of conventional technologies is disclosed in Japanese Patent Application Laid-open No. Hei 10-58667 which deals with technology of an ink-jet printer to be used for a printed circuit board (PCB) (this being referred in this application to as "second conventional technology").

In the disclosed ink-jet printer, after printing data to be supplied from an outside has been stored for a time in a hard disk, the printing data is then converted to raster data and is stored in a frame memory. When an ink tank of a print head is replaced with a new one, an operator inputs an amount of ink existing at a time when the ink tank is replaced with the new one, and the input amount of ink is dealt as a present residual amount of ink $V_c$ and if the ink tank is not replaced with the new one, a residual amount of ink RV is read from the hard disk and the read amount of the ink is dealt as the present residual amount of ink $V_c$. Then, prior to actual printing operations based on one frame of the raster data, a total amount of ink $C_P$ predicted to be consumed to do printing on all PCBs is obtained by multiplying number of coloring picture elements (dots) contained in one frame of the raster data read from the frame memory by an ink amount contained in one drop of the ink jetted and by number of the PCBs on which the printing is to be done and, at a same time, a total amount of ink $C_c$ predicted to be consumed by cleaning related to the printing of all of the PCBs is obtained by multiplying number of times of the cleaning on a printing face of a print head by an amount of ink predicted to be consumed at every time of the cleaning and by the number of the PCBs on which the printing is to be done. Then, a difference $\Delta V_c$ ($=V_c-(C_P|C_c)$) between the present residual amount of ink $V_c$ and total amount of ink ($C_p+C_c$) predicted to be consumed at time of present printing is obtained and, if the difference $\Delta V_c$ is positive, a message "Printing is enabled." is displayed and so long as an instruction for printing is not cancelled, the printing continues to be done and, after the printing is terminated, the above difference $\Delta V_c$ is written in the hard disk as the residual amount of ink RV to be used at a time of next printing and the ink-jet printer is then placed in a wait state for next printing. If the difference $\Delta V_c$ is negative, a message "Printing is disabled." is displayed and, when a number of pieces of paper on which the printing is done is changed, after a total amount of ink consumed ($C_p+C_c$) is newly calculated, all processing subsequent to the processing of calculating the above difference $\Delta V_c$ is repeated and if number of printing objects remains unchanged, the printer is placed in the wait state for next printing.

Another example is disclosed in Japanese Patent Application Laid-open No. Hei 11-157174 dealing with a printing device in which, when a stop of printing operations for execution of a printing job supplied from an outside is predicted, a result of the prediction is displayed and if an operator refers to a displayed prediction result and judges that a factor causing the stop of the printing operations cannot be removed immediately before the execution of the above printing job, the operator provides an instruction to the printer device that a printing job not having the Factor causing the stop of the printing operations, selected out of subsequent printing jobs, that is, a new printing job having a small number of pages to be printed, should be executed preferentially (this being referred to as "third conventional technology").

Furthermore, another example is disclosed in Japanese Patent Application Laid-open No. Hei 11-198474 dealing with a facsimile in which a number of pages of images actually printed during a period from a time immediately before toner runs out (a time in a "toner near end state") to a time when the toner has run out completely (a time in a "toner end state") is informed to an operator (this being referred to as "fourth conventional technology").

In the first conventional technology, since it is a prerequisite that a length of the label remains unchanged and that contents to be printed can be printed on a surface of the label and since the ink ribbon is consumed by the same length as that of the label irrespective of contents to be printed, it is possible to easily judge whether a specified number of labels can be printed or not based on a residual length of the ink ribbon and on a transported amount of the ink ribbon.

However, the first conventional technology cannot be applied to a printing device for printing, in a monochromatic or color format, printing objects containing a document, image or a like each having a variety of contents, on printing media of various sizes, because residual amounts of consumables including printing agents, printing media or a like cannot be calculated by such a simple calculation method as employed in the first conventional technology and therefore the first conventional technology has a problem in that it cannot provide a function of informing the operator of an exact disabled state of printing or residual amounts of consumables such as the printing agents, printing media or the like. Moreover, in the above first conventional technology, if the label cannot be issued, a message "Ink ribbon may run out in the middle course of printing." is displayed or a warning sound is produced, however, since concrete information about how many labels cannot be issued is not provided, the operator, once receiving such the message or the warning sound, has to repeat a change of the number of labels to he issued or has to replace a new ink ribbon until the above message disappears or until the above warning sound is stopped. Therefore, in a case where such repetition of the change of the number of labels is necessary, printing procedures are made very troublesome and time required for printing is prolonged. Moreover, in a case where there is provided no information about the number of the labels that are not issued, even if a specified number of the labels instructed to be issued is ten pieces and residual length of the ink ribbon can cover nine pieces of the labels, the ink ribbon needs replacement, thus causing an increase in the running costs.

As described above, in the second conventional technology, after data to be printed, which has been fed from the outside and stored for the time in the hard disk, is converted to the raster data and stored in the frame memory, a total amount of ink ($C_p$+$C_c$) predicted to be consumed to do printing this time is calculated based on number of coloring picture elements contained in one frame of the raster data, ink amount contained in one drop of the ink or the like. Therefore, a hard disk, frame memory or a like having a large capacity is required as a storage medium, causing the printing device to be costly and to be increased in size. Moreover, in the second conventional technology, though the message notifying that printing is disabled is displayed, as in the first conventional technology, concrete and detailed information about number of labels or a like is not provided. Because of this, the operator has to repeat changes in the numbers of printing objects to be printed after the above message has been displayed and until the message notifying that printing is enabled is displayed, or the operator, after placing the printing device in the wait state for subsequent printing and replacing its ink tank with a new one, has to do over again procedures from the beginning. Thus, the above printing device has problems in that printing procedures are troublesome, much time is required for printing and running costs are increased accordingly.

Moreover, in the second conventional technology, the operator inputs the ink amount existing when the ink tank of the print head is replaced with the new one, and the ink amount input at this point is used as the present residual amount of ink $V_c$ which is then used for calculation to judge whether the printing is enabled or disabled. Therefore, if the operator should input erroneously the amount of ink existing then or if the ink is not consumed in a manner as calculated due to some reasons, there occurs a discrepancy between the present residual amount of ink $V_c$ obtained by arithmetic operations and a residual amount of ink actually existing in the ink tank, which causes a difficulty in exact judgement as to whether the printing is enabled or not. Therefore, despite a state where printing is disabled, if the message notifying that printing is enabled is displayed and the printing is actually executed, there is a danger that ink runs out in the middle course of printing and that indiscriminate jetting occurs, which causes the PCBs to foul.

Also, in the third conventional technology, when the stop of printing operations for execution of the printing job caused by shortage of a printing medium is predicted, if it is judged, immediately before the execution of the above printing job, that the factor causing the stop of printing operations for execution of the printing job cannot be removed, the new printing job, selected out of subsequent printing jobs, having the small number of pages to be printed should be preferentially executed Thus, since the prediction as to whether printing is stopped or not is made only based on excess or deficiency of the printing medium being not associated with contents of the printing job, the preferential execution of the printing job having the small number of pages to be printed is all that is needed. However, there is a case where printing agents are consumed more for execution of the printing job having the small number of pages to be printed than for execution of a printing job having a large number of pages to be printed and, therefore, if the new printing job selected out of subsequent printing jobs is executed only because it has the small number of pages to be printed, a case occurs where the printing agents run out in a middle of printing, thus resulting in the stop of printing operations.

Furthermore, in the above fourth conventional technology, though the number of pages of the images actually printed during the period from the time immediately before toner runs out (the time in the "toner near end state") to the time when the toner has run out completely (the time in the "toner end state", is informed after printing is terminated, since it is impossible to know, in advance, the number of pages of the images that can be printed during the period from the time immediately before toner runs out to the time when the toner has run out completely, informed number of pages of the images is nothing but a guide even when a same kind of image is printed, and when a different kind of image is printed, the informed number of pages cannot be even the guide and, therefore, the fourth conventional technology is not effective in reducing running costs of the printing agents.

Since the above first to fourth conventional technologies are related to printing devices for printing objects such as monochromatic documents or images, it is natural that no consideration is provided to overcome inconveniences in printing devices to print objects such as color documents or images. That is, a color of the printing agent required for monochromatic printing is black (B) only, while colors of the printing agent required for color printing include three types of colors, cyan (C), magenta (M) and yellow (Y) or four types of colors, cyan (C), magenta (M), yellow (Y) and black (B). Out of these printing agents, at least, the cyan, magenta and yellow printing agents are placed in tanks or cartridges formed integrally with the printing device. Therefore, running costs cannot be efficiently reduced by judging whether printing is enabled or disabled merely based on total amount of ink to be consumed or on number of pages to be printed. It is necessary to consider contents of documents or images to be printed which consume printing agents, that is, consideration is necessary as to whether printing objects to be printed consume much cyan or magenta color printing agent or whether it consumes mainly yellow color printing agents, or which color printing agent is most consumed to do printing of the printing object and so on.

SUMMARY OF THE INVENTION

In view of the above, it is an object of the present invention to provide a printing control method capable of informing, in a short time, an operator of whether printing is enabled or disabled or of an exact residual amount of printing agents, in response to a simple operation of the operator, even when printing objects including a variety of monochromatic or color documents or images are to be printed and capable of reducing efficiently running costs of printing agents and providing a printing device and a printing control device configured so as to be cost-effective and small-sized, which are operated in accordance with the above printing control method and a storage medium storing a program for the printing control method.

According to a first aspect of the present invention, there is provided a printing control method including:

a first step of creating, based on a printing object containing a document and/or an image, printing data composed of a character printing command providing an instruction for printing each of characters making up the document and/or a graphic drawing command providing an instruction for drawing a straight line and/or a curve making up the image and of calculating an amount of each of two or more kinds of printing agents each having a different color predicted to be consumed to do printing on a printing medium based on the printing data; and a second step of doing printing on the printing medium based on the printing data when a measured residual amount of each of the two or more kinds printing agents each having a different color is larger than the amount of each of the two or more kinds of printing agents each having the different color predicted to be consumed to do printing and of providing, if the measured residual amount of each of the two or more kinds of printing agents each having the different color is smaller than the amount of each of the two or more kinds of printing agents each having the different color predicted to be consumed to do printing, a notification about this condition.

In the foregoing, a preferable mode is one wherein, in the second step described above, after having provided the notification that the measured residual amount of each of the two or more kinds of printing agents each having the different color is smaller than the amount of each of the two or more kinds of printing agents each having the different color predicted to be consumed to do printing, the printing data is discarded.

According to a second aspect of the present invention, there is provided a printing control method including:

a first step of creating, based on a printing object containing a document and/or an image, printing data composed of a character printing command providing an instruction for printing each of characters making up the document and/or a graphic drawing command providing an instruction for drawing a straight line and/or a curve making up the image and of calculating an amount of each of two or more kinds of printing agents each having a different color predicted to be consumed to do printing on a printing medium based on the printing data;

a second step of providing a notification about a measured residual amount of each of the two or more kinds of printing agents each having the different color and a notification about an amount of each of the two or more kinds of printing agents each having the different color predicted to be consumed to do printing, a notification prompting for an instruction to perform either of printing or abortion of printing, a notification about whether printing based on the printing data is possible or not and a notification about whether any of the two or more kinds of printing agents is not sufficient for printing; and a third step of doing printing on the printing medium based on the printing data, when an instruction for printing is provided in response to the notification, irrespective of the residual amount of each of the two or more kinds of printing agents each having the different color and of discarding the printing data and data on the amount of each of the two or more kinds of printing agents each having the different color predicted to be consumed to do printing.

According to a third aspect of the present invention, there is provided a printing control method including:

a first step of sequentially creating, based on two or more kinds of printing objects each containing a document or an image, two or more pieces of printing data composed of character printing commands each providing an instruction for printing each of characters making up the document and graphics drawing commands each providing an instruction for drawing a straight line and/or a curve making up the image and of sequentially calculating an amount of each of two or more kinds of printing agents each having a different color predicted to be consumed to do printing of tale two or more kinds of printing objects on a printing medium based on the two or more pieces of printing data;

a second step of providing a notification about an amount of each of the two or more kinds of printing agents each having the different color predicted to be consumed to do printing of two or more kinds of printing objects in accordance with a predetermined printing order and a notification about a residual amount of each of the two or more kinds of printing agents each having the different color being left after having done printing of each of the two or more kinds of printing objects, the residual amount of which is obtained by sequentially subtracting, in accordance with the predetermined printing order, the amount of each of the two or more kinds of printing agents each having the different color predicted to be consumed to do printing of the two or more kinds of printing objects, from a measured residual amount of each of the two or more kinds of printing agents each having the different color, a notification prompting for an instruction to perform any one of printing, abortion of printing and scheduling for changing printing order for the two or more kinds of printing objects in accordance with a predetermined algorithm, a notification about whether printing of all of the two or more kinds of printing objects is possible or not and a notification about whether there is any printing object that is unable to be printed due to shortage of any one of the two or more kinds of printing agents each having the different color or not; and a third step of doing printing, when an instruction to perform printing is provided in response to the notification, on the printing medium based on printing data about a printing object, which is included in the two or more kinds of printing objects, being able to be printed using the measures residual amount of each of the two or more kinds of printing agents each having the different color, of discarding, when an instruction to abort the printing is provided in response to the notification, the printing data about the two or more kinds of printing objects and data about the amount of each of the two or more kinds of printing agents each having the different color predicted to be consumed to do printing of each of the two or more kinds of printing objects, of changing printing order for the two or more kinds of printing objects, when an instruction to perform scheduling processing is provided in response to the notification, in accordance with the predetermined algorithm, and of notifying the amount of each of the two or more kinds of printing agents each having the different color predicted to be consumed to do printing of each of the two or more kinds of printing objects in accordance with changed printing order and a residual amount of each of the two or more kinds of printing agents each having the different color being left after having done printing of each of the two or more kinds of printing objects, the residual amount of which is obtained by sequentially subtracting, in accordance with changed printing order, the amount of each of the two or more kinds of printing agents each having the different color predicted to be consumed to do printing of each of the two or more kinds of printing objects, from the measured residual amount of each of the two or more kinds of printing agents each having the different color, and of providing notification prompting for instruction to perform any one of printing, abortion of the printing and the scheduling processing, notification about whether printing of all of the two or more kinds of printing objects is possible or not and notification about whether there is any kind of printing object that is unable to be printed due to shortage of any one of the two or more kinds of printing agents each having the different color or not.

In the foregoing, a preferable mode is one wherein, after having done the printing, if there is left any printing object that has not yet been printed, notification prompting for instruction to replace tanks or cartridges containing the two or more kinds of printing agents each having the different color is provided and when, in response to the instruction, the tanks or cartridges are replaced, the second step and onward is repeated.

Also, a preferable mode is one wherein, in the second step described above, if the printing based on the printing data created from any of the two or more kinds of printing objects is impossible by using the measured residual amount of each of the two or more kinds of printing agents each having the different color, instead of the notification or together with the notification, a notification prompting for replacing the tanks or cartridges containing the two or more kinds of printing agents each having the different color is provided.

Also, a preferable mode is one wherein the predetermined algorithm includes a first process of selecting combined sets composed of the two or more kinds of printing objects in various combinations, of calculating amount of each of the two or more kinds of printing agents each having the different color predicted to be consumed, of obtaining a difference between a residual amount of each of the two or more kinds of printing agents each having the different color and a sum of the amount of each of the two or more kinds of printing agents each having the different color predicted to be consumed and, if any combination out of the combinations meets conditions for being printed that a sum of the difference for each of the two or more kinds of printing agents each having the different color is minimum and the difference for each of the two or more kinds of printing agents each having the different color is more than 0 (zero), using the combination as printing order that should be employed after being scheduled, and a second process of selecting, if any combination selected out of all combinations composed of the two or more kinds of printing objects does not meet the conditions, combined sets composed of printing objects the number of the kinds of which is smaller by one than that of the two or more kinds of printing objects, of calculating the sum of an amount of each of the two or more kinds of printing agents each having the different color predicted to be consumed, of obtaining a difference between a residual amount of each of the two or more kinds of printing agents each having the different color and the sum of an amount of each of the two or more kinds printing agents each having the different color predicted to be consumed for each of the combinations, and if any combination out of these combinations that can meet the conditions exists, of using printing order in which a high priority is assigned to the combination and a low priority is assigned to a printing object not contained in the combination as printing order that should be employed after being scheduled, and wherein, if there is no combination that can meet the conditions out of all combinations prepared by the second step, combined sets composed of printing objects the number of the kinds of which is further decreased by one are selected and same procedures that are taken in the second step are repeated.

According to a fourth aspect of the present invention, there is provided a printing device including:

a consumed amount calculating section to calculate an amount of each of two or more kinds of printing agents each having a different color predicted to be consumed to do printing of a printing object on a printing medium based on printing data in synchronization with a printing data creating section, which is mounted in a control unit, adapted to create, based on the printing object containing a document and/or an image, the printing data composed of a character printing command providing an instruction for printing each of characters making up the document and/or a graphic drawing command providing an instruction for drawing a straight line and/or a curve making up the image;

a printing section to do printing on the printing medium based on the printing data by using the two or more kinds of printing agents each having the different color;

a residual amount measuring section to measure a residual amount of each of the two or more kinds of printing agents each having the different color existing in the printing section;

a consumed amount comparing section to compare the residual amount of each of the two or more kinds of printing agents each having the different color with the amount of each of the two or more kinds of printing agents each having the different color predicted to be consumed to do printing; and a control section to control the printing section so as to do printing based on the printing data if a result of comparison by the consumed amount comparing section shows that the residual amount of each of the two or more kinds of printing agents each having the different color is not less than an amount of each of the two or more kinds of printing agents each having the different color predicted to be consumed and to provide, if the result of comparison by the consumed amount comparing section shows that the residual amount of each of the two or more kinds of printing agents each having the different color is less than the amount of each of the two or more kinds of printing agents each having the different color predicted to be consumed, a notification about the comparison result.

In the foregoing, a preferable mode is one wherein the control section discards the printing data after having provided the notification about the comparison results.

According to a fifth aspect of the present invention, there is provided a printing device including:

a consumed amount calculating section to calculate an amount of each of two or more kinds of printing agents each having a different color predicted to he consumed to do printing of a printing object on a printing medium based on printing data in synchronization with a printing data creating section, which is mounted in a control unit, adapted to create, based on the printing object containing a document and/or an image, the printing data composed of a character printing command providing an instruction for printing each of characters making up the document and/or a graphic drawing command providing an instruction for drawing a straight line and/or a curve making up the image;

a printing section to do printing on the printing medium based on the printing data by using the two or more kinds of printing agents each having the different color;

a residual amount measuring section to measure a residual amount of each of the two or more kinds of printing agents each having the different color existing in the printing section;

a consumed amount comparing section to compare the residual amount of each of the two or more kinds of printing agents each having the different color with the amount of each of the two or more kinds of printing agents each having the different color predicted to be consumed to do printing; and a control section to provide a notification about a residual amount of each of the two or more kinds of printing agents each having the different color, a notification about an amount of each of the two or more kinds of printing agents each having the different color predicted to be consumed to do printing, a notification prompting for an instruction to perform either of printing or abortion of printing, a notification about whether printing based on the printing data is possible or not based on the result of comparison by the consumed amount comparing section, a notification about whether any of the two or more kinds of printing agents is not sufficient for printing, to control, if the instruction to perform printing is provided in response to the notification, the printing section so as to do printing on the printing medium based on the printing data, irrespective of the residual amount of each of the two or more kinds of printing agents each having the different color, and to discard the printing data and data on the amount of each of the two or more kinds of printing agents each having the different color predicted to be consumed, if the instruction to abort printing is provided in response to the notification.

According to a sixth aspect of the present invention, there is provided a printing device including:

a consumed amount calculating section to calculate an amount of each of two or more kinds of printing agents each having a different color predicted to be consumed to do printing of two or more kinds of printing objects on a printing medium based on two or more pieces of printing data in synchronization with a printing data creating section, which is mounted in a control unit, adapted to create, based on the two or more kinds of printing objects each containing a document and/or an image, sequentially the two or more pieces of printing data composed of character printing commands each providing an instruction for printing each of characters making up the document and graphics drawing commands each providing an instruction for drawing a straight line and/or a curve making up the image;

a printing section to do printing of the two or more kinds of printing objects on the printing medium based on the two or more pieces of printing data by using the two or more kinds of printing agents each having the different color;

a residual amount measuring section to measure a residual amount of each of the two or more kinds of printing agents each having the different color existing in the printing section;

a consumed amount comparing section to compare the residual amount of each of the two or more kinds of printing agents each having the different color with the amount of each of the two or more kinds of printing agents each having the different color predicted to be consumed to do printing of each of the two or more kinds of printing objects; and a control section to provide a notification about the amount of each of two or more kinds of printing agents each having the different color predicted to be consumed to do printing of the two or more kinds of printing objects in accordance with predetermined printing order and a notification about a residual amount of each of two or more kinds of printing agents each having the different color being left after having done printing of each of the two or more kinds of printing objects, the amount of which is obtained by sequentially subtracting, in accordance with predetermined printing order, the amount of each of the two or more kinds of printing agents each having the different color predicted to be consumed to do printing of the two or more kinds of printing objects, from a measured residual amount of each of the two or more kinds of printing agents each having the different color, to provide a notification prompting for an instruction to perform any one of printing, abortion of printing and scheduling for changing printing order for the two or more kinds of printing objects in accordance with a predetermined algorithm, a notification about whether printing of all of the two or more kinds of printing objects is possible or not and a notification about whether there is any kind of printing object that is unable to be printed due to shortage of any one of the two or more kinds of printing agents or not, to do printing, when the instruction to perform printing is provided in response to the notification, on the printing medium based on printing data on the printing objects, which is included in the two or more kinds of printing objects, being able to be printed using the measured residual amount of each of the two or more kinds of printing agents each having the different color, to discard, when the instruction to abort the printing is provided in response to the notification, the printing data on the two or more kinds of printing objects and data on the amount of each of the two or more kinds of printing agents each having the different color predicted to be consumed to do printing of each of the two or more kinds of printing objects, to change printing order for the two or more kinds of printing objects, when the instruction to perform scheduling processing is provided in response to the notification, in accordance with the predetermined algorithm, to notify the amount of each of the two or more kinds of printing agents each having the different color predicted to be consumed to do printing of each of the two or more kinds of printing objects in accordance with changed printing order and a residual amount of each of the two or more kinds of printing agents each having the different color being left after having done printing of each of the two or more kinds of printing objects, the residual amount of which is obtained by sequentially subtracting, in accordance with the changed printing order, the amount of each of the two or more kinds of printing agents each having the different color predicted to be consumed to do printing of each of the two or more kinds of printing objects, from the measured residual amount of each of the two or more kinds of printing agents each having the different color, and to provide notification prompting for an instruction to perform any one of printing, abortion of the printing and the scheduling processing, notification about whether printing of all of the two or more kinds of printing objects is possible or not and notification about whether there is any printing object that is unable to be printed due to shortage of any one of the two or more kinds of printing agents or not.

In the foregoing, a preferable mode is one wherein the control section, if there is any printing object that has not been printed even after printing processing has been completed, provides a notification prompting for replacing tanks or cartridges containing two or more kinds of printing agents each having the different color and, when the tanks or cartridges are replaced, the processing is continued.

Also, a preferable mode is one wherein the control section, if the printing based on the printing data created from any of the two or more kinds of printing objects is impossible by using the measured residual amount of each of the two or more kinds of printing agents each having the different color, instead of the notification or together with the notification, provides the notification prompting for replacing the tanks or cartridges containing the two or more kinds of printing agents each having the different color.

Also, a preferable mode is one wherein the predetermined algorithm includes a first process of selecting combined sets composed of the two or more kinds of printing objects in various combinations, calculating an amount of each of the two or more kinds of printing agents each having the different color predicted to be consumed, obtaining a difference between a residual amount of each of the two or more kinds of printing agents each having the different color and a sum of the amount of each of the two or more kinds of printing agents predicted to be consumed and, if any combination out of the combinations meets conditions for being printed that a sum of the difference for each of the two or more kinds of printing agents each having the different color is minimum and the difference for each of the two or more kinds of printing agents each having the different color is more than 0 (zero), using the combination as printing order that should be employed after being scheduled, and a second process of selecting, if any combination selected from all combinations composed of the two or more kinds of printing objects does not meet the conditions, combined sets composed of printing objects the number of the kinds of which is smaller by one than that of the two or more kinds of printing objects, of calculating a sum of an amount of each of the two or more kinds of printing agents each having the different color predicted to be consumed, obtaining a difference between a residual amount of each of the two or more kinds of printing agents each having the different color and the sum of an amount of each of the two or more kinds of printing agents each having the different color predicted to be consumed for each of the combinations and, if any combination out of these combinations that can meet the conditions exists, using printing order in which a high priority is assigned to the combination and a low priority is assigned to a printing object not contained in the combination as printing order that should be employed after being scheduled, and wherein, if there is no combination that can meet the conditions out of all combinations obtained by the second process, combined sets composed of printing objects the number of kinds of which is further decreased by one are selected and procedures taken in the second process are repeated.

According to a seventh aspect of the present invention, there is provided a printing control device including:

a printing data creating section to create, based on a printing object containing a document and/or an image, printing data composed of a character printing command providing an instruction for printing each of characters making up the document and/or a graphic drawing command providing an instruction for drawing a straight line and/or a curve making up the image;

a consumed amount calculating section to calculate, in synchronization with the printing data creating section, an amount of each of two or more kinds of printing agents each having a different color predicted to be consumed to do printing of the printing object on a printing medium based on printing data;

a printing section to do printing of the printing object on the printing medium based on the printing data by using two or more kinds of printing agents each having the different color;

a residual amount measuring section to measure a residual amount of each of the two or more kinds of printing agents each having the different color existing in the printing section;

a consumed amount comparing section to compare the residual amount of each of the two or more kinds of printing agents each having the different color with the amount of each of the two or more kinds of printing agents each having the different color predicted to be consumed; and a control section to control the printing section so as to do printing based on the printing data if a result of comparison by the consumed amount comparing section shows that the residual amount of each of the two or more kinds of printing agents each having the different color is not less than the amount of each of the two or more kinds of printing agents each having the different color predicted to be consumed and to provide a notification, if the result of comparison by the consumed amount comparing section shows that the residual amount of each of the two or more kinds of printing agents each having the different color is less than the amount of each of the two or more kinds of printing agents each having the different color predicted to be consumed, about the comparison result.

In the foregoing, it is preferable that the control section discards the printing data after providing the notification about the comparison results.

According to an eight aspect of the present invention, there is provided a printing control device including:

a printing data creating section to create, based on a printing object containing a document and/or an image, printing data composed of a character printing command providing an instruction for printing each of characters making up the document and/or a graphic drawing command providing an instruction for drawing a straight line and/or a curve making up the image;

a consumed amount calculating section to calculate, in synchronization with the printing data creating section, an amount of each of two or more kinds of printing agents each having a different color predicted to be consumed to do printing of the printing object on a printing medium based on printing data;

a printing section to do printing of the printing object on the printing medium based on the printing data by using the two or more kinds of printing agents each having the different color;

a residual amount measuring section to measure a residual amount of each of the two or more kinds of printing agents each having the different color existing in the printing section;

a consumed amount comparing section to compare the residual amount of each of the two or more kinds of printing agents each having the different color with the amount of each of the two or more kinds of printing agents each having the different color predicted to be consumed; and a control section to provide a notification about the residual amount of each of two or more kinds of printing agents each having the different color, a notification about the amount of each of two or more kinds of printing agents each having the different color predicted to be consumed, a notification prompting for the instruction to perform either of printing or abortion of printing, a notification about whether printing based on the printing data is possible or not based on the result of comparison of the consumed amount comparing section, a notification about whether any of the two or more kinds of printing agents is not sufficient for printing, and to control, if the instruction to perform printing is provided in response to the notification, the printing section so as to do printing on the printing medium based on the printing data, irrespective of the residual amount of each of the two or more kinds of printing agents each having the different color, and to discard the printing data and data on the amount of each of the two or more kinds of printing agents each having the different color predicted to be consumed, if the instruction to abort printing is provided in response to the notification.

According to a ninth aspect of the present invention, there is provided a printing control device including:

a printing data creating section to create, based on the two or more kinds of printing objects each containing a document and/or an image, sequentially the two or more pieces of printing data composed of character printing commands each providing an instruction for printing each of characters making up document and graphics drawing commands each providing an instruction for drawing a straight line and/or a curve making up the image;

a consumed amount calculating section to calculate, in synchronization with the printing data creating section, an amount of each of two or more kinds of printing agents each having a different color predicted to be consumed to do printing of two or more kinds of printing objects on a printing medium based on two or more pieces of printing;

a printing section to do printing of the two or more kinds of printing objects on the printing medium based on the two or more pieces of printing data by using the two or more kinds or printing agents each having the different color;

a residual amount measuring section to measure a residual amount of each of the two or more kinds of printing agents each having the different color existing in the printing section;

a consumed amount comparing section to compare the residual amount of each of the two or more kinds of printing agents each having the different color with an amount of each of the two or more kinds of printing agents each having the different color predicted to be consumed to do printing of each of the two or more kinds of printing objects; and a control section to provide a notification about the amount of each of two or more kinds of printing agents each having the different color predicted to be consumed to do printing of two or more kinds of printing objects in accordance with a predetermined printing order and a notification about a residual amount of each of the two or more kinds of printing agents each having the different color being left after having done printing of each of the two or more kinds of printing objects, amount of which is obtained by sequentially subtracting, in accordance with the predetermined printing order, the amount of each of two or more kinds of printing agents each having the different color predicted to be consumed to do printing of the two or more kinds of printing objects, from the measured residual amount of each of the two or more kinds of printing agents each having the different color, to provide a notification prompting for an instruction to perform any one of printing, abortion of printing and scheduling for changing printing order for the two or more kinds of printing objects in accordance with a predetermined algorithm, a notification about whether printing of all of the two or more kinds of printing objects is possible or not and a notification about whether there is any printing object that is unable to be printed due to shortage of any one of the two or more kinds of printing agents or not, to do printing, when the instruction to perform printing is provided in response to the notification, on the printing medium based on printing data about the two or more kinds of printing objects being able to be printed using the measured residual amount of each of the two or more kinds of printing agents each having the different color, to discard, when the instruction to abort the printing is provided in response to the notification, the printing data on the two or more kinds of printing objects and data on the amount of each of the two or more kinds of printing agents each having the different color predicted to be consumed to do printing of each of the two or more kinds of printing objects, to charge printing order for the two or more kinds of printing objects, when the instruction to perform scheduling processing is provided in response to the notification, in accordance with the predetermined algorithm, to notify the amount of each of the two or more kinds of printing agents each having the different color predicted to be consumed to do printing of each of the two or more kinds of printing objects in accordance with changed printing order and the residual amount of each of the two or more kinds of printing agents each having the different color being left after having done printing of each of the two or more kinds of printing objects, the residual amount of which is obtained by sequentially subtracting, in accordance with the changed printing order, the amount of each of the two or more kinds of printing agents each having the different color predicated to be consumed to do printing of each of the two or more kinds of printing objects, from the measured residual amount of each of the two or more kinds of printing agents each having the different color, and to provide the notification prompting for the instruction to perform any one of the printing, the abortion of the printing and the scheduling processing, the notification about whether printing of all of the two or more kinds of printing objects is possible or not and the notification about whether there is any printing object that is unable to be printed due to shortage of any one of the two or more kinds of printing agents or not.

In the foregoing, it is preferable that the control section, if there is any printing object that has not been printed even after the printing processing has been completed, provides a notification prompting for replacing tanks or cartridges containing the two or more kinds of printing agents each having the different color and when the tanks or cartridges are replaced, the processing is continued.

Also, it is preferable that the control section, if the printing based on the printing data created from any of the two or more kinds of printing objects is impossible by using the measured residual amount of each of the two or more kinds of printing agents each having the different color, instead of the notification or together with the notification, provides the notification prompting for replacing the tanks or cartridges containing the two or more kinds of printing agents each having the different color.

Also, it is preferable that the predetermined algorithm includes a first process of selecting combined sets composed of the two or more kinds of printing objects in various combinations, calculating the amount of each of the two or more kinds of printing agents each having the different color predicted to be consumed, obtaining the difference between the residual amount of each of the printing agents each having the different color and a sum of the amount of each of the two or more kinds of printing agents predicted to be consumed and, if any combination out of the combinations meets conditions for being printed that a sum of the difference for each of the two or more kinds of printing agents each having the different color is minimum and the difference for each of the printing agents each having the different color is more than 0 (zero), using the combination as printing order that should be employed after being scheduled, and a second process of selecting, if any combination selected from all combinations composed of the two or more kinds of printing objects does not meet the conditions, combined sets composed of printing objects a number of kinds of which is smaller by one than that of the two or more kinds of printing objects, of calculating the sum of an amount of each of the two or more printing agents each having the different color predicted to be consumed, of obtaining the difference between a residual amount of each of the two or more kinds of printing agents each having the different color and the sum of an amount of each of the printing agents each having the different color predicted to be consumed for each of the combinations, and if any combination out of these combinations that can meet the conditions exists, of using printing order in which a high priority is assigned to the combination and a low priority is assigned to a printing object not contained in the combination as printing order that should be employed after being scheduled, and wherein, if there is no combination that can meet the conditions out of all combinations obtained by the second process, combined sets composed of printing objects the number of kinds of which is further decreased by one are selected and same procedures that are taken in the second process are repeated.

According to a tenth aspect of the present invention, there is provided a storage medium storing a printing control program in a computer to implement functions stated above.

With the above configuration, since printing data composed of a character printing command, a graphics drawing command or a like is created based on a printing object containing a document or an image and an amount of each of printing agents such as ink predicted to be consumed to do printing of two or more kinds of printing objects on a printing medium is calculated based on the created printing data, and unlike the second conventional technology described above, a storage medium such as a hard disk or a frame memory or a like having a large capacity is not required, thus allowing the printing device to be cost-effective and small-sized, and also unlike the second conventional technology, a process of storing the printing data for a time in a hard disk, converting the printing data to raster data and storing the converted raster data in a frame memory and then reading the raster data to calculate all the amounts of the printing agents is not required, thus allowing time required for printing to be shortened.

Also, unlike the second conventional technology, the residual amount of the ink is obtained by actual measurement, not by arithmetic operation and therefore no discrepancy in the residual amount exists between the residual amount predicted to be left based on the arithmetic operation and the residual amount being actually left. As a result, an exact judgement as to whether printing is possible or not can be made and an inconvenience event in which a printing medium is fouled caused by a trouble that the ink runs out in the middle course of printing can be prevented.

Moreover, after information that a residual amount of each of two or more printing agents is smaller than an amount of each of two or more printing agents predicted to be consumed is given to the operator, since the printing data is discarded to prevent the printing data being left in a meaningless state, the operator can obtain high convenience.

Furthermore, an amount of each of two or more kinds of printing agents each having a different color and a residual amount of each of the two or more kinds of printing agents each having a different color are informed, the operator can obtain exact information about an amount of each of the printing agents predicted to be consumed for each color and a residual amount of each of the printing agents for each color. This enables the operator to perform subsequent processing promptly and time required for printing to be shortened, printing agents to be used efficiently and running costs to be reduced accordingly.

With another configuration as above, a notification prompting for an instruction to perform either of printing or abortion of the printing is provided and information is given as to whether printing is possible or not and as to whether a residual amount of each of the printing agents is sufficient or not, and when an instruction for performing the printing is provided in response to the information, the printing on a printing medium is done based on printing data irrespective of a residual amount of each of the two or more kinds of printing agents each having a different color and when an instruction for aborting the printing is provided, since printing data and data on the amount of each of the two or more kinds of printing agents each having a different color have been discarded, the operator can abort the printing even if there is no problem in the residual amount of the printing agent and the operator can do printing even if there is a problem in the residual amount of the printing agent, which makes the application of the printing device wider.

Also, with still another configuration as above, since scheduling for printing order is performed based on an amount of each of printing agents predicted to be consumed to do printing of printing objects and a residual amount of each of printing agent being actually left, printing agents can be used more efficiently compared with a case where scheduling is made without considering contents of the printing object as in the case of the third conventional technology, which allows a reduction of running costs and printing of more printing objects.

With still more another configuration as above, if any printing object that has not been printed is left, a notification prompting for an instruction to replace tanks or cartridges containing two or more printing agents each having a different color is provided and, when the tanks or cartridges are replaced, since the previous processing is repeated to do printing of the printing object that had not been printed, the more the number or kind of printing objects that the operator wants to print is, the more efficiently the ink can be used and the more the running costs can be reduced. Therefore, even in a case where printing objects containing a document, image or a like having various contents in a monochromatic or color format are printed, the operator can obtain exact information about possibility of printing, concrete residual amounts of the printing agents by a simple operation and within a short time.

BRIEF DESCRIPTION OF THE DRAWINGS

The above and other objects, advantages and features of the present invention will be more apparent from the following description taken in conjunction with the accompanying drawings in which:

FIG. 11 is a diagram explaining one example of operations of the printing control device according to the third embodiment of the present invention;

FIG. 12 is a diagram explaining another example of operations of the printing control device according to the third embodiment of the present invention; and FIG. 13 is a diagram explaining still another example of operations of the printing control device according to the third embodiment of the present invention.

DETAILED DESCRIPTION OF THE PREFERRED EMBODIMENTS

Best modes of carrying out the present invention will be described in further detail using various embodiments with reference to the accompanying drawings.

First Embodiment

Figure 1:
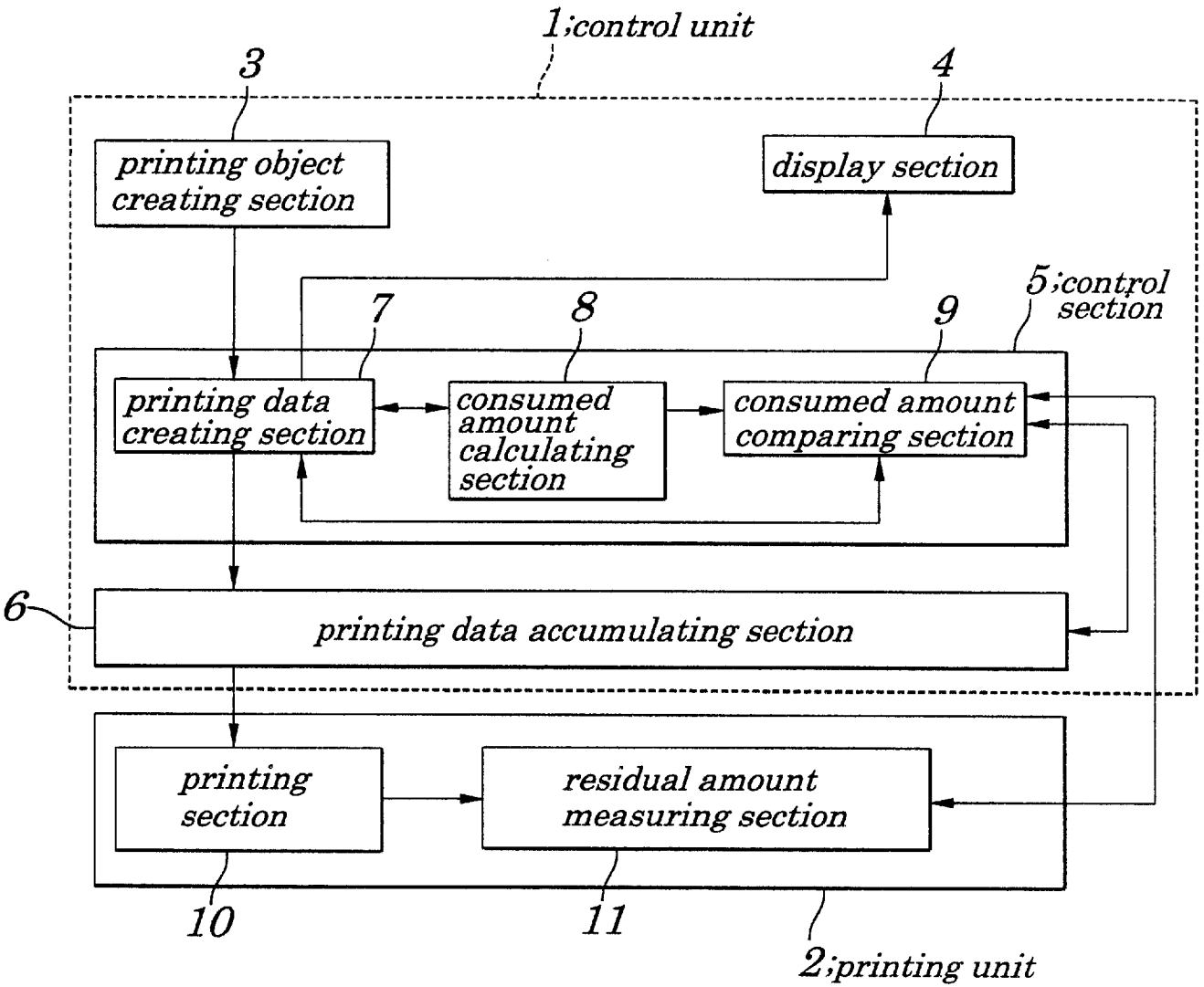
FIG. 1 is a schematic block diagram showing configurations of a printing control device according to a first embodiment of the present invention.

FIG. 1 is a schematic block diagram showing electric configurations of a printing control device according to a first embodiment of the present invention. As shown in FIG. 1, the printing control device is chiefly composed of a control unit 1 and a printing unit 2. The control unit 1 is mainly composed of a printing object creating section 3, a display section 4, a control section 5 and a printing data accumulating section 6. The printing object creating section 3 creates a printing object containing a document, image or a like and instructs the control section 5 to start various kinds of processing including creation of printing data based on the created printing objects or a like. The display section 4 is composed of a CRT display, a liquid crystal display or a like and displays, when printing is enabled, a message informing it. The control section 5, in accordance with instructions fed from the printing object creating section 3, performs various processing including creation of printing data based on printing objects fed from the printing object creating section 3. The printing data accumulating section 6, which is generally called a spooler, is composed of storage media such as RAM or a like and stores temporarily printing data supplied from the control section 5.

The control section 5 is chiefly composed of a printing data creating section 7, a consumed amount calculating section 8 and a consumed amount comparing section 9. The printing data creating section 7 processes printing objects supplied from the printing object creating section 3 and creates printing data. The consumed amount calculating section 9 calculates, in synchronization with the printing data creating section 7, an amount of each of cyan, magenta and yellow printing agents (cyan, magenta and yellow ink in this example) consumed in the printing unit 2 in order to do printing based on printing data created by the printing data creating section 7. The consumed amount comparing section 9 compares an amount of each of three kinds of ink predicted to be consumed which is informed by the consumed amount calculating section 8, and a residual amount of each of the three kinds of the ink which is informed by the printing unit 2 and notifies the printing data creating section 7 of a comparison result.

The printing unit 2 is an ink jet printer to perform printing of monochromatic or color printing objects on a printing medium using, for example, each of cyan, magenta and yellow ink and is mainly composed of a printing section 10 and a residual amount measuring section 11. The printing section 10 is chiefly composed of an ink jet printing head (not shown), a driving circuit (not shown) to drive the ink jet printing head, a head driving motor (not shown) to scan the ink jet printing head, a transporting section (not shown) to transport a storage medium and a control portion (not shown) to control each of components making up the printing unit 2 based on printing data to be fed from the control unit 1. The ink jet printing head is mainly composed of two or more pressure generating chambers (not shown) to be filled with ink supplied from cartridges formed integrally with an ink tank (not shown) which is provided to each of the cyan, magenta and yellow ink, two or more vibrating plates (not shown) constituting an upper plate of each of the two or more pressure generating chambers, two or more piezo-electric actuators (not shown) mounted on an upper face of the two or more vibrating plates and two or more nozzles (not shown) to jet drops of ink from an end protruding through one face of each of the pressure generating chambers and performs printing of printing objects containing a character, an image or a like on a printing medium by jetting drops of ink driven by a driving waveform signal generated by the driving circuit (not shown) fed to a specified piezo-electric actuator operated in a manner to correspond to printing data. The residual amount measuring section 11 detects a residual amount of each of the cyan, magenta, yellow ink and feeds resulting data to the control unit 1. As one of methods for detecting the residual amount of ink, a following procedure is available. That is, since the ink tank is provided to each of the cyan, magenta and yellow ink, for example, to an upper face and a lower face of each ink tank is attached an electrode plate (two plates, one each) to which a predetermined voltage is applied. Since capacitance and resistance of a capacitor composed of the two electrode plates and the ink varies depending on the residual amount of the ink, a current flowing between the two electrode plates changes. By measuring the current, the residual amount of each ink can be detected.

Figure 2:
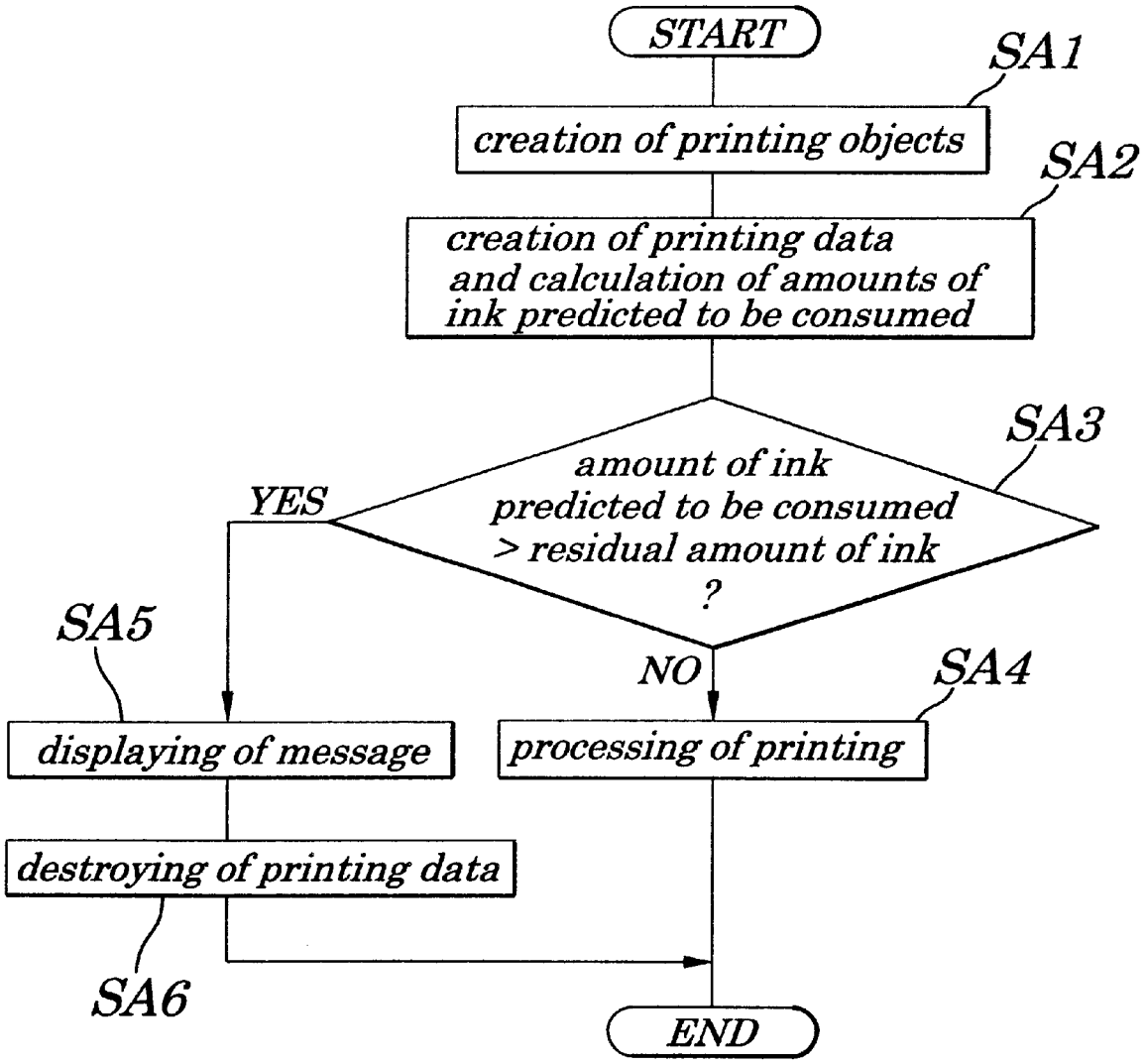
FIG. 2 is a flowchart explaining one example of operations of the printing control device according to the first embodiment of the present invention.
Figure 3:
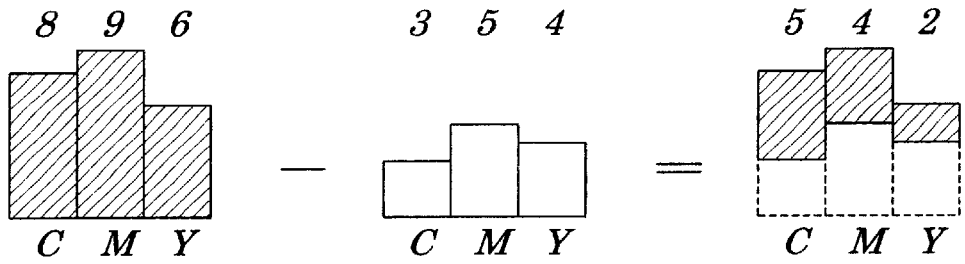
FIG. 3 is a diagram explaining one example of operations of the printing control device according to the first embodiment of the present invention.
Figure 4:
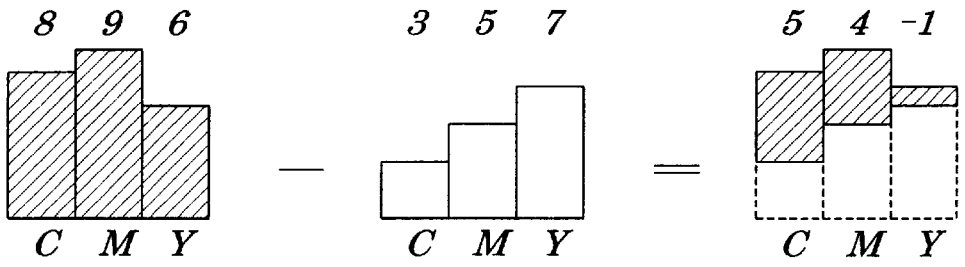
FIG. 4 is a diagram explaining another example of operations of the printing control device according to the first embodiment of the present invention.

Next, one example of operations of the printing control device having configurations as described above is described by referring to a flowchart shown in FIG. 2 and to FIGS. 3 and 4. First, the printing object creating section 3 creates a printing object containing a document, image or a like and instructs the control section 5 to start various processing of creating printing data based on the creation of printing objects (Step SA1). The printing data creating section 7 creates printing data by processing the printing object fed from the printing object creating section 3 and the consumed amount calculating section 8 calculates, in synchronization with the printing data creating section 7, an amount of each of the cyan, magenta and yellow ink predicted to be consumed by the printing unit 2, to perform printing based on the printing data created by the printing data creating section 7 (Step SA2). In the example, the creation of printing data and the calculation of an amount of each of the three kinds of the ink predicted to be consumed are performed simultaneously. One example is described below; that is, when, in an X/Y coordinate system, a black straight line extending from coordinates (1, 1) to coordinates (1, 10) is to be created, if an amount of each of the cyan, magenta and yellow ink predicted to be consumed by creating the black straight line extending from the coordinates (1, 1) to coordinates (1, 2) is 0.3 ml, an amount of each of the cyan, magenta and yellow ink predicted to be consumed by creating the black straight line from the coordinates (1, 1) to the coordinates (1, 10) becomes 3 ml, which is ten times larger than the amount of each of the three kinds of the ink predicted to be consumed by creating the straight line extending from the coordinates (1, 1) to the coordinates (1, 2). Thus, if an instruction is given that a black straight line extending from the coordinates (1, 1) to the coordinates (1, 10) is to be created as a printing object, the printing data creating section 7 creates, as printing data, a line creating command to instruct the printing unit 2 to create the black straight line extending from the coordinates (1, 1) to the coordinates (1, 10) and, at a same time, the consumed amount calculating section 8 calculates, in accordance with the line creating command, and informs that an amount of each of the cyan, magenta and yellow ink predicted to be consumed by creating the above straight line is 3 ml. That is, the amount of each of the color inks predicted to be consumed by creating a drawing can be calculated by calculating an area in which the drawing is created with each of the color inks and by multiplying a resulting calculated area by the amount of each ink predicted to be consumed by creating a unit drawing. Moreover, when a character is to be printed, since an amount of each ink predicted to be consumed by printing the character can be calculated, in advance, for every font and size of the character, the printing data creating section 7 creates a character printing command to instruct the printing unit 2 to print, for example, a document in black, as printing data and, at the same time, the consumed amount calculating section 8 calculates, based on the amount of each ink predicted to be consumed by printing each character which has been calculated in advance, an amount of each of the cyan, magenta and yellow ink predicted to be consumed by printing the document.

Next, the printing data creating section 7 instructs the consumed amount comparing section 9 to compare the amount of each of the cyan, magenta and yellow ink predicted to be consumed, which has been calculated by the consumed amount calculating section 9, with a residual amount of each of the cyan, magenta and yellow ink which is informed by the printing unit 2 and then to judge whether the amount of each ink predicted to be consumed is larger than the residual amount of each ink or not (Step SA3). If the judgement result is "NO", the printing data creating section 7 judges that printing is possible and, after storing temporarily the created printing data in the printing data accumulating section 6 and, after instructing the printing unit 2 to perform the printing based on printing data, terminates a series of the printing processes (Step SA4). In response to the instruction, the printing section 10 of the printing unit 2 performs printing of the printing object based on the printing data, on a printing medium using each of the cyan, magenta and yellow ink. In the above case, for example, as shown in a left of FIG. 3, let it be assumed that a relative value of a residual amount of the cyan ink is 8, a relative value of a residual amount of the magenta ink is 9 and a relative value of a residual amount of the yellow ink is 6. If, as shown in a center of FIG. 3, a relative value of an amount of the cyan ink predicted to be consumed by printing data is 3, a relative value of an amount of the magenta ink predicted to be consumed by printing the same is 5 and a relative value of an amount of the yellow ink predicted to be consumed by printing the same is 4 and, if the above printing data is printed, as shown in a right of FIG. 3, a relative value of a residual amount of the cyan ink becomes 5, a relative value of a residual amount of the magenta ink becomes 4 and a relative value of a residual amount of the yellow ink becomes 2. This means that each ink is sufficient and the printing is possible.

On the other hand, if a result of the judgement is "YES", that is, if an amount of each ink predicted to be consumed is larger than a measured residual amount of each ink, the printing data creating section 7 judges that the printing is impossible and outputs a message on the display section 4 that the printing is not allowed (for example, a message "Printing is disabled due to lack of ink") (Step SA5). Then, the printing data creating section 7, after discarding the created printing data, terminates a series of the printing processes (Step SA6). In the above case, for example, as shown in a left of FIG. 4, let it be assumed that a relative value of a residual amount of the cyan ink is 8, a relative value of a residual amount of the magenta ink is 9 and a relative value of a residual amount of the yellow ink is 6. If, as shown in a center of FIG. 4, a relative value of an amount of the cyan ink predicted to be consumed by printing data is 3, a relative value of an amount of the magenta ink predicted to be consumed by printing the same is 5 and a relative value of an amount of the yellow ink predicted to be consumed by printing the same is 7 and, if the above data is printed, as shown in a right of FIG. 4, a relative value of a residual amount of the cyan ink becomes 5, a relative value of a residual amount of the magenta ink becomes 4 and a relative value of a residual amount of the yellow ink becomes −1. This means that the yellow ink is not sufficient and the printing is impossible.

Thus, according to the first embodiment, since the creation of printing data and the calculation of an amount of each ink are performed simultaneously, unlike in the case of the second conventional technology, a hard disk, frame memory or a like having a large capacity is not required as a storage medium and it is possible to configure the printing device so as to be cost-effective and small-sized. Moreover, since such complicated processes including the process of storing printing data, for a while, in a hard disk, process of converting the printing data to raster data and of storing the converted data in a frame memory and further process of reading the raster data from the frame memory and of calculating all amounts of the ink consumed as needed in the second conventional technology, are not required, time required for printing can be shortened. Furthermore, according to the first embodiment, since a residual amount of each ink is actually measured by the residual amount measuring section 11 mounted on the printing unit 2, there is not such a discrepancy between a residual amount of ink obtained by arithmetic operations and a residual amount of ink actually measured as seen in the second conventional technology. This enables an exact judgement as to whether printing is possible or not and prevents a troublesome event in which a printing medium is fouled from being caused by an inconvenience that the ink runs out in the middle course of printing.

Second Embodiment

Figure 5:
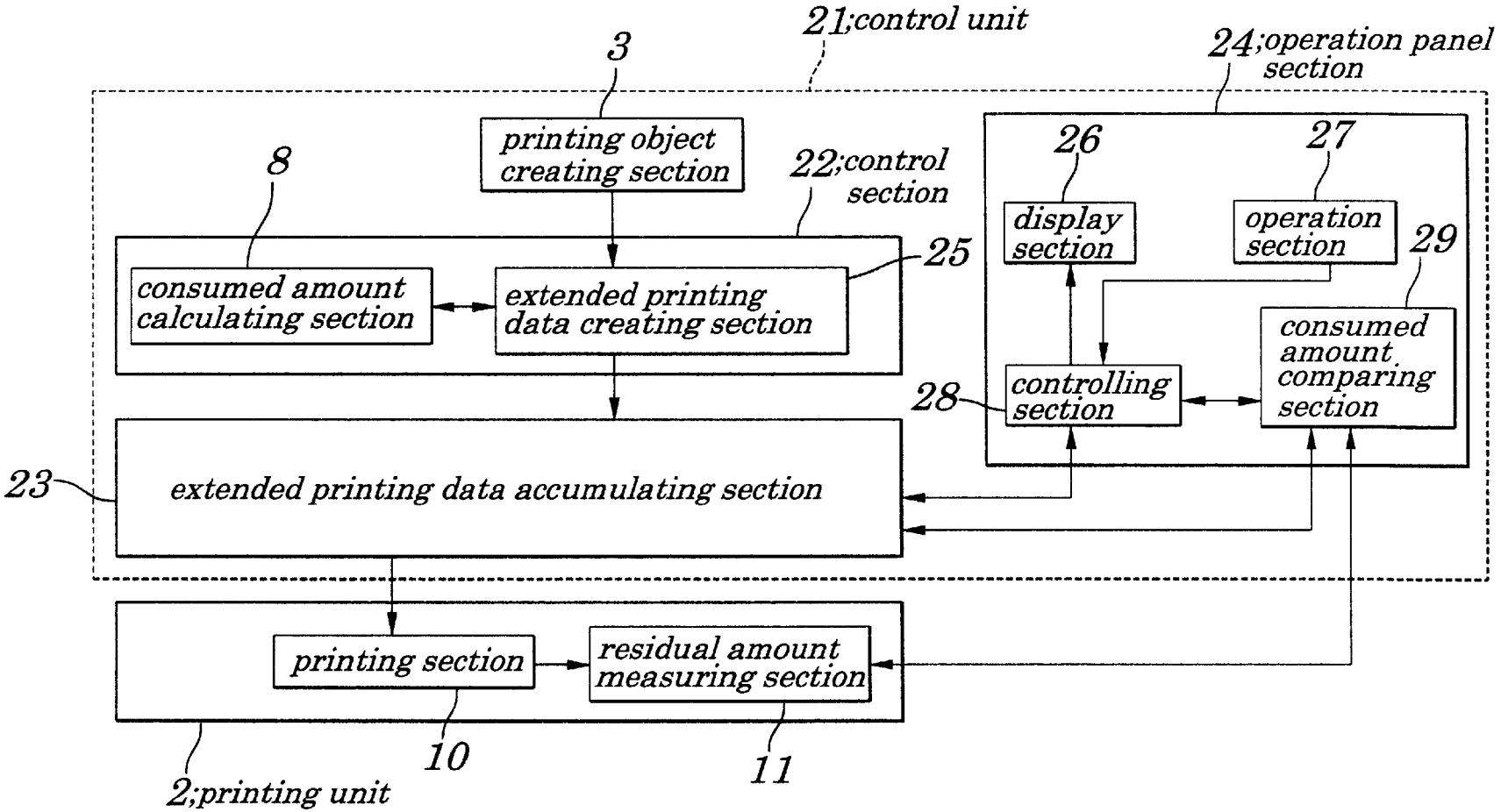
FIG. 5 is a schematic block diagram showing configurations of a printing control device according to a second embodiment of the present invention.

FIG. 5 is a schematic block diagram showing electric configurations of a printing control device according to a second embodiment of the present invention. In FIG. 5, same reference numbers are assigned to parts having same functions as in FIG. 1. In the printing control device of the second embodiment, instead of control unit 1 shown in FIG. 1, a control unit 21 is newly provided. The control unit 21 is chiefly composed of a printing object creating section 3, a control section 22, an extended printing data creating section 25 and an operation panel 24.

The printing object creating section 3 creates a printing object containing a document, image or a like and instructs the control section 22 to start various kinds of processing such as creation of printing data based on the created printing object. The control section 22 performs processing of creating printing data based on printing objects that are supplied from the printing object creating section 3 and under instructions from the printing object creating section 3 and is mainly composed of the extended printing data creating section 25 and consumed amount calculating section 8. The extended printing data creating section 25 processes a printing object fed from the printing object creating section 3 and creates printing data based on the printing object and, at a same time, creates extended printing data containing an amount of each of cyan, magenta and yellow ink predicted to be consumed by printing unit 2 which is to be calculated by the consumed amount calculating section 8 in synchronization with the extended printing data creating section 25.

An extended printing data accumulating section 23 is generally called a "spooler" which is composed of a storage medium such as RAM or a like and stores temporarily extended printing data to be fed from the control section 22. The operation panel section 24 is mainly composed of a display section 26, an operation section 27, a controlling section 28 and a consumed amount comparing section 29. The display section 26 is composed of a CRT display, liquid crystal display or a like and is used to display a variety of messages, a present residual amount of each ink left in the printing unit 2, an amount of each ink predicted to be consumed when printing of a subsequent printing object is to be done, or like. The operation section 27 is so configured that, when a "keytop" displayed on a screen of the display section 26 is pressed by an operator on a touch panel mounted on the display section 26, an item indicated by the keytop is input. The controlling section 28, in accordance with information about results of comparison between an amount of each ink predicted to be consumed and measured residual amount of each ink, which has been fed from the consumed amount comparing section 29, instructs the display section 26 to display a variety of messages or a like, and performs various kinds of processing in response of key input by the operator on the operation section 27. The consumed amount comparing section 29 compares an amount of each of the cyan, magenta and yellow ink predicted to be consumed, which constitutes extended printing data temporarily stored in the extended printing data accumulating section 23, with the residual amount of each ink which is informed by the printing unit 2 and notifies the controlling section 28 of comparison result.

Figure 6:
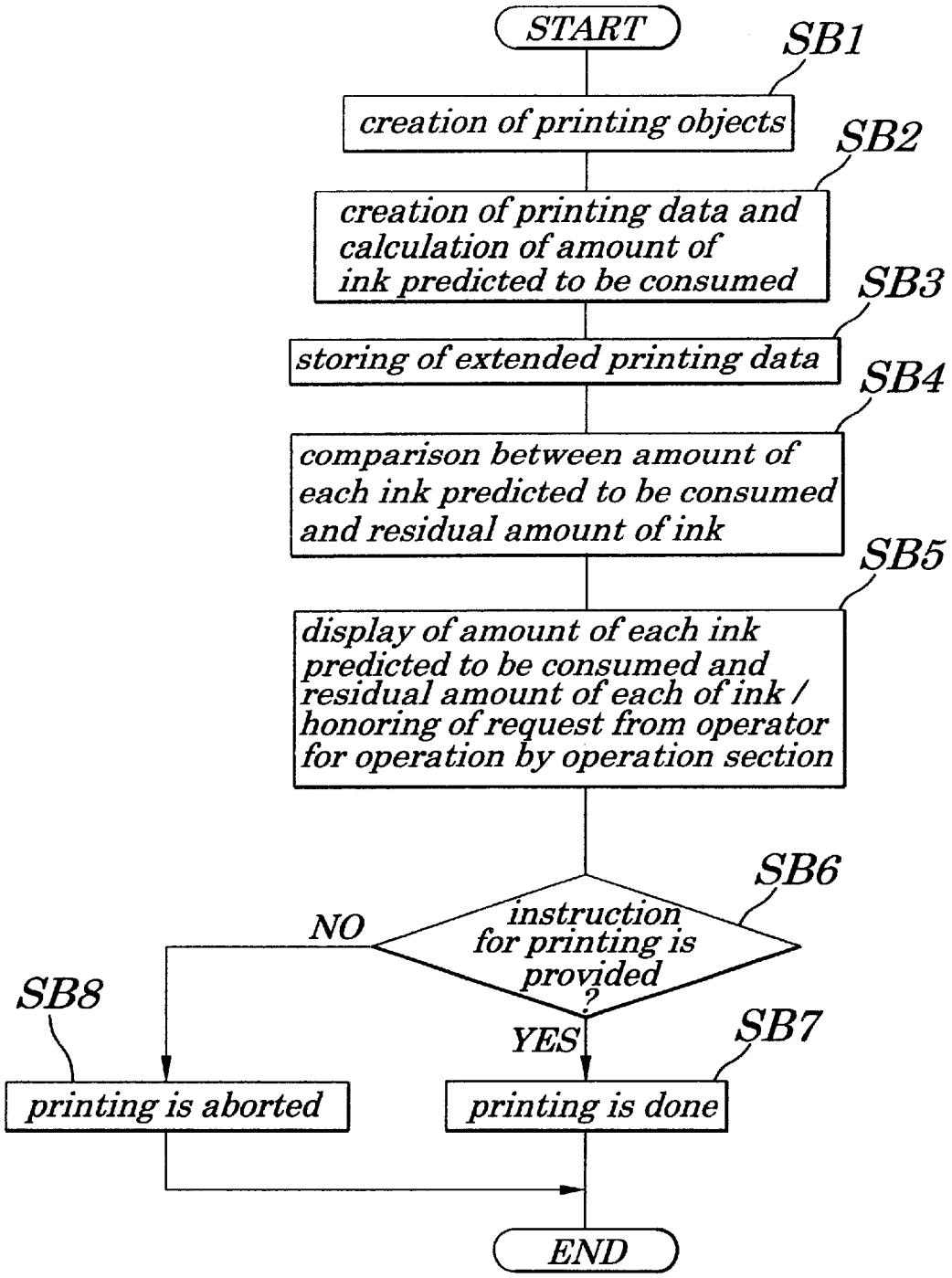
FIG. 6 is a flowchart explaining one example of operations of the printing control device according to the second embodiment of the present invention.

Next, one example of operations of the printing control device having configurations as described above will be described by referring to a flowchart in FIG. 6 and to FIGS. 3, 4, 7 and 8. First, the printing object creating section 3 creates a printing object containing a document, image or a like and instructs the control section 22 to start various kinds of processing including creation of printing data based on the created printing object or a like (Step SB1) The extended printing data creating section 25 creates printing data by processing the printing object fed from the printing object creating section 3 and the consumed amount calculating section 8 calculates, in synchronization with the extended printing data creating section 25, the amount of each of the cyan, magenta and yellow ink predicted to be consumed by the printing unit 2, to perform printing of the printing data created by the extended printing data creating section 25 (Step SB2). In the example, creation of the printing data and the calculation of the amount of each ink predicted to be consumed are simultaneously performed.

Next, the extended printing data creating section 25, after creating extended printing data composed of printing data and amount of each ink predicted to be consumed, temporarily stores the extended printing data in the extended printing data accumulating section 23 (Step SB3). As a result, the operation panel section 24 makes the consumed amount comparing section 29 read an amount of each of the cyan, magenta and yellow ink making up the extended printing data being temporarily stored in the extended printing data accumulating section 23. A read result is compared with the residual amount of each of the cyan, magenta and yellow ink notified by the printing unit 2 and comparison results are obtained (Step SB4).

Then, the controlling section 28, based on comparison results fed from the consumed amount comparing section 29, selects a message to be output on the display section 26 and displays, together with the message, the amount of each of the cyan, magenta and yellow ink predicted to be consumed, the residual amount of each ink, information as to whether printing of the printing object is possible or not, information as to whether each ink is sufficient for printing or not, information as to which ink is not sufficient and a notification to instruct the printing to be done or to instruct the printing to be aborted, on the display section 26. The controlling section 28 honors a request from the operator that operations of the operation section 27 are performed (Step SB5).

Figure 7:
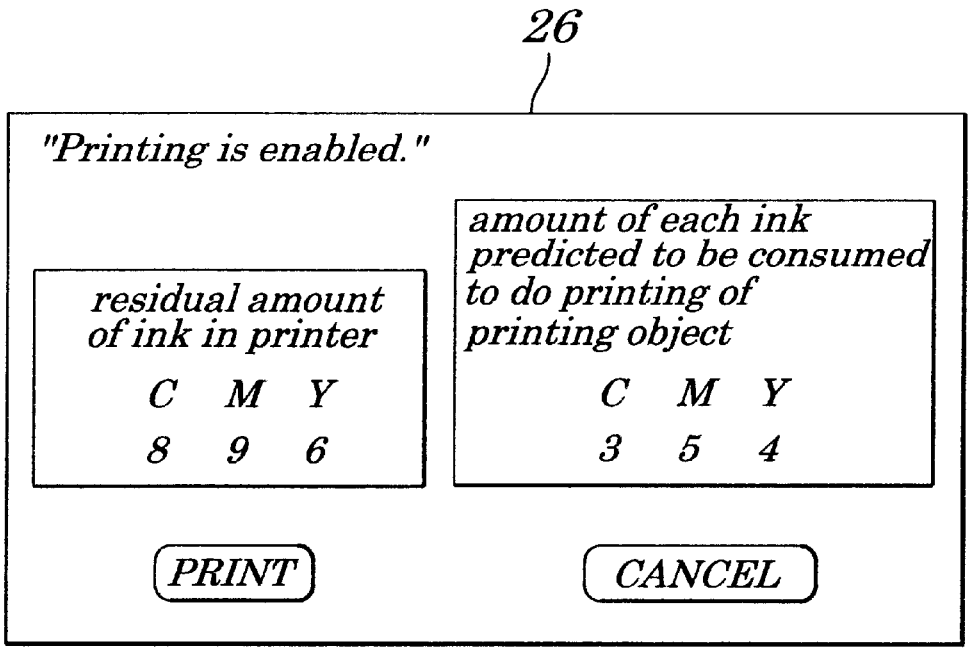
FIG. 7 is a diagram explaining one example of operations of the printing control device according to the second embodiment of the present invention.

In the above case, for example, as shown in the left of FIG. 3, let it be assumed that a relative value of a residual amount of the cyan ink is 8, a relative value of a residual amount of the magenta ink is 9 and a relative value of a residual amount of the yellow ink is 6. If, as shown in the center of FIG. 3, a relative value of an amount of the cyan ink predicted to be consumed by printing an object is 3, a relative value of an amount of the magenta ink predicted to be consumed by printing same is 5 and a relative value of an amount of the yellow ink predicted to be consumed by printing the same is 4 and, if the above printing data is printed, as shown in the right of FIG. 3, a relative value of a residual amount of the cyan ink becomes 5, a relative value of a residual amount of the magenta ink becomes 4 and a relative value of a residual amount of the yellow ink becomes 2. This means that each ink is sufficient and the printing is possible. Therefore, the controlling section 28, for example, as shown in FIG. 7, displays, together with a message "Printing is enabled", the residual amount of each ink (cyan C: 8, magenta M: 9 and yellow Y: 6) in the printing unit 2, the amount of each ink predicted to be consumed by printing the printing object (cyan C: 3, magenta M: 5 and yellow Y:4) and the keytops "PRINT" and "CANCEL" on the display section 26, and is placed in a wait state after the operator touches either of the keytops "PRINT" and "CANCEL" and until a signal confirming the operator's touch is received from the operation section 27.

On the other hand, for example, as shown in the left of FIG. 4, let it be assumed that a relative value of a residual amount of the cyan ink is 8, a relative value of a residual amount of the magenta ink is 9 and a relative value of a residual amount of the yellow ink is 6. If, as shown in the center of FIG. 4, a relative value of an amount of the cyan ink predicted to be consumed by printing an object is 3, a relative value of an amount of the magenta ink predicted to be consumed by printing same is 5 and a relative value of an amount of the yellow ink predicted to be consumed by printing the same is 7 and, if the above printing data is printed, as shown in a right of FIG. 4, a relative value of a residual amount of the cyan ink becomes 5, a relative value of a residual amount of the magenta ink becomes 4 and a relative value of a residual amount of the yellow ink becomes −1. This means that the yellow ink is not sufficient and the printing is impossible. Therefore, the controlling section 28, for example, as shown in FIG. 8, displays, together with messages "Ink is not sufficient" and "Yellow (Y) ink is not sufficient for this printing object", the residual amount of each ink (cyan C: 8, magenta M: 9 and yellow Y: 6) in the printing unit 2, the amount of each ink predicted to be consumed by printing the printing object (cyan C: 3, magenta M: 5 and yellow Y:7) and the keytops "PRINT" and "CANCEL" on the display section 26, and is placed in a wait state until either of the keytops "PRINT" or "CANCEL" is touched by the operator and a signal confirming the operator's touch is supplied from the operation section 27.

Next, the controlling section 28 judges whether the instruction to do printing is provided from the operator, that is, whether the keytop "PRINT" is touched by the operator and a signal confirming the operator's touch is supplied from the operation section 27 (Step SB6). If the judgement result is "YES", the controlling section 28, after reading printing data from the extended printing data accumulating section 23 and feeding it to the printing unit 2 and then instructing the printing unit 2 to do printing based on the printing data (Step SB7), terminates a series of printing processes. The printing section 10 of the printing unit 2 prints, based on the printing data, the printing object on a printing medium using each of the cyan, magenta and yellow ink. In the example shown in FIG. 7, since no problem lies in the residual amount of the ink, a normal printing result is obtained. In the case shown in FIG. 8, since a problem lies in the residual amount of the ink, though only improper printing results are obtained, the printing can be used for test printing, for example, for a check of a printing layout.

On the other hand, if the judgement result in Step SB6 is "NO", that is, if the keytop "CANCEL" is touched by the operator and a signal confirming the operator's touch is supplied from the operation section 27 and the instruction to abort the printing is provided by the operator, the controlling section 28, after performing all processes required for aborting the printing including destruction of the extended printing data temporarily stored in the extended printing data accumulating section 23, terminates a series of printing processes (Step SB8). Moreover, in the example shown in FIG. 7, though no problem lies in the residual amount of the ink, if necessary, the printing can be aborted due to other reasons, however, in the case shown in FIG. 8, since problems lie in the residual amount of ink and since it is clear that only an improper result is produced, in ordinary cases, the printing is aborted.

Figure 8:
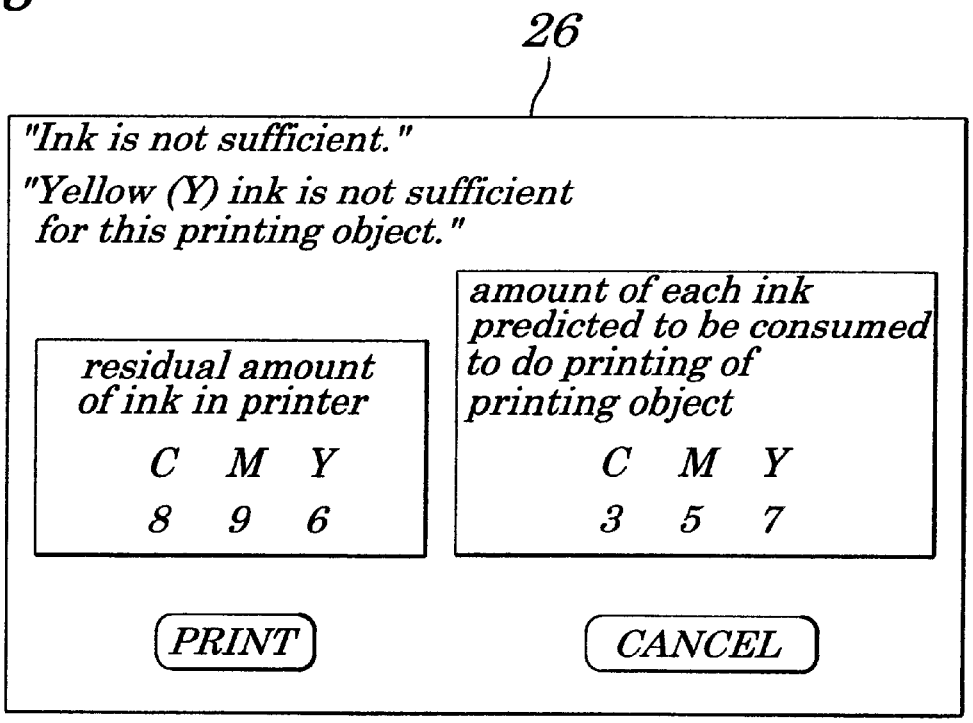
FIG. 8 is a diagram explaining another example of operations of the printing control device according to the second embodiment of the present invention.

Thus, according to the second embodiment, in addition to effects achieved in the first embodiment, effects can be obtained that the operator can exactly know the amount of each ink predicted to be consumed and the residual amount of each ink existing in the printer because, as shown in FIGS. 7 and 8, the amount of each ink predicted to be consumed and the residual amount of the ink can be concretely displayed on the display section 26 of the control unit 21. This allows the operator to promptly perform subsequent processing required for printing and time required for the printing can be shortened. Furthermore, since the ink is efficiently used, running costs can be reduced. Also, according to the second embodiment, since the instruction to do printing or to abort the printing, together with messages "Printing is enabled" or "Ink is not sufficient", can be displayed on the display section 26, irrespective of overs and shorts of the ink, the operator can abort the printing even if there is no problem in the residual amount of ink and can do printing even if there is problem in the residual amount of ink, thus making wider application of the printing device.

Third Embodiment

Figure 9:
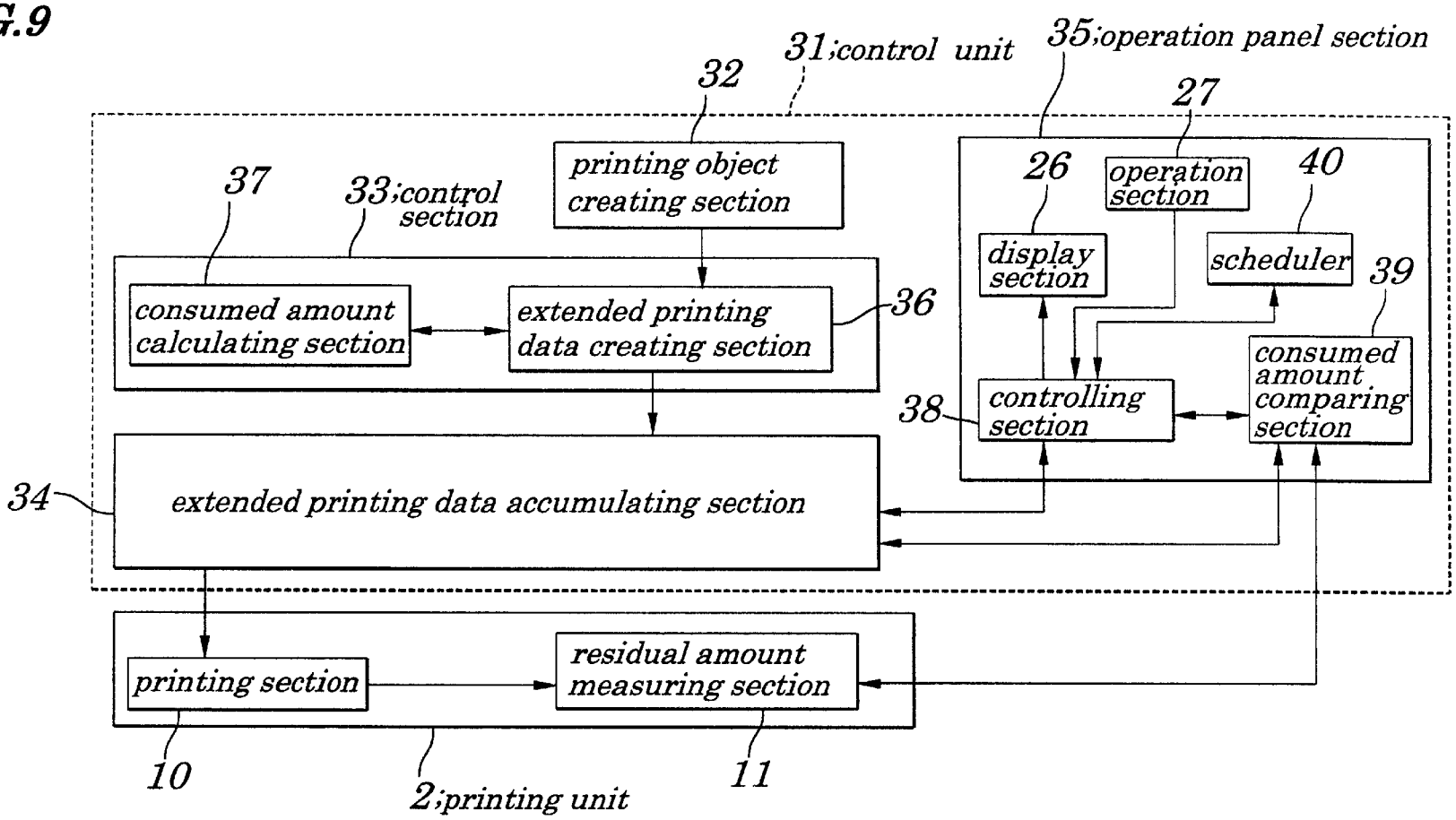
FIG. 9 is a schematic block diagram showing configurations of a printing control device according to a third embodiment of the present invention.

FIG. 9 is a schematic block diagram showing electric configurations of a printing control device according to a third embodiment. In FIG. 9, same reference numbers are assigned to parts having same functions as in FIG. 5 and descriptions of them are omitted accordingly. In the printing control device of the third embodiment, instead of control unit 21 shown in FIG. 5, a control unit 31 is newly mounted. The control unit 31 is chiefly composed of a printing object creating section 32, a control section 33, an extended printing data accumulating section 34 and an operation panel section 35.

The printing object creating section 32 sequentially creates two or more kinds of printing objects which an operator wants to print and instructs the control section 33 to start various kinds of processing including creation of two or more pieces of printing data based on the created two or more kinds of printing objects. The control section 33, performs, in accordance with instructions from the printing object creating section 32, various kinds of processing including the creation of the printing data based on the two or more kinds of printing objects which are supplied from the printing object creating section 32 and is mainly composed of an extended printing data creating section 36 and a consumed amount calculating section 37. The extended printing data creating section 36 creates both two or more pieces of printing data by processing two or more kinds of printing objects which are fed from the printing object creating section 32 and two or more pieces of extended printing data composed of an amount of each of cyan, magenta and yellow ink predicted to be consumed for each of two or more pieces of the printing data by printing unit 2, which has been calculated by the consumed amount calculating section 37 in synchronization with the extended printing data creating section 36. The consumed amount calculating section 37 calculates an amount of each of the cyan, magenta and yellow ink predicted to be consumed by the printing unit for each of the two or more pieces of the printing data in order to do printing of the two or more pieces of the printing data created sequentially by the extended printing data creating section 36.

The extended printing data accumulating section 34 is generally called the spooler, which is constructed of storage media such as RAM or a like, and is used to temporarily store the two or more pieces of extended printing data which are fed from, the control section 33. The operation panel section 35 is mainly composed of a display section 26, an operation section 27, a controlling section 38, a consumed amount comparing section 39 and a scheduler 40. The controlling section 38, based on a result of comparison between an amount of each ink predicted to be consumed for each of the two or more pieces of printing data which is informed by the consumed amount comparing section 39 and a residual amount of each ink, displays various messages on the display section 26 and performs various kinds of processing in response to input through the key of the operation section 27 by an operator. The consumed amount comparing section 39 compares an amount of each of the cyan, magenta and yellow ink predicted to be consumed corresponding to each of the two or more pieces of the printing data making up the two or more pieces of extended printing data being temporarily stored in the extended printing data accumulating section 34 with a residual amount of each ink notified by the printing unit 2.

The scheduler 40, when an instruction for scheduling processing is provided by the operator, decides printing order for two or more kinds of printing objects based on a predetermined algorithm under control of the controlling section 38 and feeds information about the printing order to the controlling section 38. One example of the algorithm used here is shown below. That is, combined sets composed of all the two or more kinds of printing objects that the operator wants to print are selected in various combinations and a sum of an amount of each ink predicted to be consumed is calculated, and then a difference between a residual amount of each ink and a sum of the amount of each ink predicted to be consumed is obtained. Then, whether any selected combination out of the combinations of the two or more kinds of printing objects can meet conditions (necessary conditions for being printed) that a sum (that is, a sum of the residual amount or each ink) of a difference for each ink becomes minimum and a difference for each ink is not less than 3 (zero), is checked and, if the combination can meet the conditions, the printing order obtained by this combination is used as printing order for the printing object that is to be employed after being scheduled. On the other hand, if any one of combinations composed of all the two or more kinds of printing objects that the operator wants to print cannot meet the above conditions for being printed, combined sets composed of (N−1) pieces of printing objects (hereafter referred to as a "first group of printing objects") whose number of pieces of printing objects is smaller by one than the number (N) of printing objects that the operator wants to print, are selected in various combinations and then a sum of an amount of each ink predicted to be consumed is calculated for each of the combinations and a difference between the sum of an amount of each ink predicted to be consumed and a sum of a residual amount of each ink is obtained for each of the combinations. Then, whether any selected combination that can meet the above conditions for being printed exists in these combinations or not is checked and, if it exists, printing order in which a higher priority is assigned to the combination that can meet the above conditions and a lower priority is assigned to a printing object not contained in the combination is selected as printing order for printing objects that should be employed after being scheduled. On the other hand, if any combination meeting the above conditions for being printed out of combinations of all printing objects making up the first group of printing objects does not exist, (N−2) pieces of printing objects (hereafter referred to as a second group of printing objects) are selected in various combinations and then a sum of an amount of each ink predicted to be consumed is calculated for each of the combinations and a difference between the sum of an amount of each ink predicted to be consumed and a sum of a residual amount of each ink is obtained for each of the combinations. Then, whether any combination that can meet the above conditions for being printed exists in these combinations or not is checked and, if it exists, printing order in which a higher priority is assigned to the combination that can meet the above conditions and a lower priority is assigned to a printing object not contained in the combination is selected as printing order for printing objects that should be employed after being scheduled. If no combination that can meet the conditions for being printed exists in the combinations of printing objects making up the second group of the printing objects, the number of printing objects making up the combination is reduced by one thereafter and the processing described above is repeated.

For example, when the operator wants printing objects "A, B, C and D" to be printed, if the combination "A, B, C and D" meets the above printing conditions, printing order of "A, B, C and D" of the printing objects in the combination is used as printing order that should be employed after being scheduled. If the combination "A, B, C and D" does not meet the above printing conditions, in all combinations composed of (N−1) pieces in the example, N=4) of printing objects making up the first group, "A, B and C", "A, B and D", "A, C and D" and "B, C and D", a sum of an amount of each ink predicted to be consumed is calculated for each of the combinations and then a difference between a residual amount of each ink and the sum of an amount of each ink predicted to be consumed for each of the combinations is obtained. Then, whether any combination that can meet the above conditions for being printed exists in these combinations or not is checked and, if it exists, printing order in which a higher priority is assigned to the combination that can meet the above conditions and a lower priority is assigned to a printing object not contained in the combination is selected as printing order for printing objects that should be employed after being scheduled. For example, if the combination "A, B and D" meets the above conditions, printing order "A, B, D and C" in which a higher priority is assigned to the combination "A, B and D" and a lower priority is assigned to the printing object "C" not contained in the combination "A, B and D", is selected as printing order for printing objects that should be employed after being scheduled.

On the other hand, if no combination that can meet the above conditions exists in the combinations of printing objects making up the first group "A, B and C", "A, B and D", "A, C and D" and "B, C and D", the processing described above is repeated for all the combinations composed of two printing objects making up the second group "A and B", "A and C", "A and D", "B and C", "B and D" and "C and D".

Figure 10:
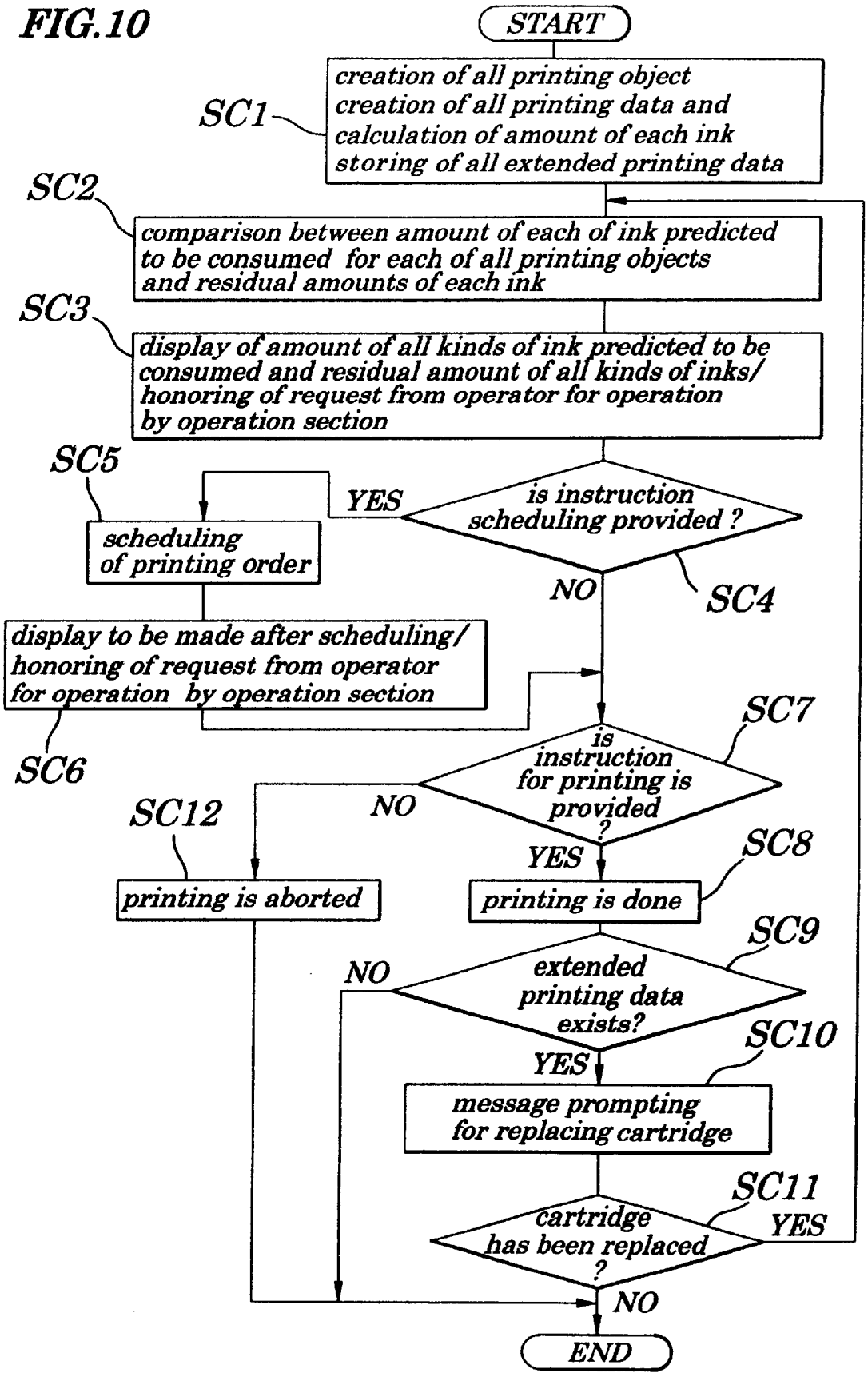
FIG. 10 is a flowchart explaining one example of operations of the printing control device according to the third embodiment of the present invention.

Next, one example of operations of the printing control device having configurations described above will be described by referring to a flowchart in FIG. 10 and to diagrams in FIGS. 11 to 13. In the embodiment, for example, the operator wants printing objects A, B, C and D to be printed, a relative value of a residual amount of ink left before the printing operation is started is 20 for cyan ink, 20 for magenta ink and 20 for yellow ink.

First, the printing object creating section 32 sequentially creates two or more kinds of printing objects that the operator wants to print in order instructed by the operator and instructs the control section 33 to start various kinds of processing of creation of printing data based on created printing object or a like. Moreover, in the embodiment, for example, the printing order (A, B, C and D) for printing objects instructed by the operator is not one to which the operator intentionally gives a higher priority. The extended printing data creating section 36 processes two or more kinds of printing objects fed from the printing object creating section 32 to create two or more pieces of printing data each corresponding to each of the printing objects and the extended printing data accumulating section 34, in synchronization with the extended printing data creating section 36, calculates an amount of each of the cyan, magenta and yellow ink predicted to be consumed for each piece of the two or more pieces of printing data by the printing unit 2, to sequentially print two or more pieces of printing data created by the extended printing data creating section 36. In the example, the creation of printing data and the calculation of amounts of each ink predicted to be consumed are performed simultaneously.

In the embodiment, a relative value of a calculated amount of the ink predicted to be consumed for doing printing of printing data created a printing object A is, for example, 5 for cyan ink, 7 for magenta ink and 7 for yellow ink, a relative value of a calculated amount of the ink predicted to be consumed for doing printing of printing data created based on a printing object B is, for example, 7 for the cyan ink, 4 for the magenta ink and 6 for the yellow ink, a relative value of a calculated amount of the ink predicted to be consumed to do pointing of printing data created based on a printing object C is, for example, 2 for the cyan ink, 5 for the magenta ink and 4 for the yellow ink and a relative value of a calculated amount of the ink predicted to be consumed for doing printing of printing data created based on a printing object D is 8 for the cyan ink, 9 for the magenta ink and 7 for the yellow ink.

Next, the extended printing data creating section 36, after creating two or more of pieces of extended printing data composed of two or more pieces of printing data and an amount of each ink for each corresponding printing data, stores temporarily the two or more pieces of the extended printing data in the extended printing data accumulating section 34 (Step SC1). The controlling section 38 of the operation panel section 35 controls the consumed amount comparing section 39 to cause the section 39 to read an amount of each of the two or more kinds of ink predicted to be consumed, which makes up two or more pieces of the extended printing data corresponding to two or more kinds of printing objects, from the extended printing data accumulating section 24 and to subtract, when processing a first printing object, an amount of each ink predicted to be consumed, from a residual amount of each ink informed by the printing unit 2 and to obtain a result of subtraction for each ink and a sum of the result from the subtraction for each ink, that is, a total residual amount ink, and to subtract, when processing a second printing object and downward, an amount of each ink predicted to be consumed to print the second printing object and downward, from the result of the subtraction for each ink calculated for the previous printing object and downward and to obtain a result of the subtraction for each ink and a total residual amount of all kinds of inks (Step SC2).

In the embodiment, an amount of each ink predicted to be consumed to do printing of the printing object A (for example, 5 for the cyan ink, 7 for the magenta ink and 7 for the yellow ink) is read, the amount of each ink predicted to be consumed (for example, 5 for the cyan ink, 7 for the magenta ink and 7 for the yellow ink) is subtracted from a residual amount of each ink (for example, 20 for the cyan ink, 20 for the magenta ink and 20 for the yellow ink), and results of the subtraction (15 for the cyan ink, 13 for the magenta ink and 13 for the yellow ink) and a total residual amount of all kinds of the ink (41) are obtained. Next, an amount of each ink predicted to be consumed for do printing of the printing object B (for example, 7 for the cyan ink, 4 for the magenta ink and 6 for the yellow ink) is read and the amount of each ink predicted to be consumed for doing printing of the printing object B is subtracted from a result of the subtraction for each ink predicted to be consumed to do printing of the printing object A (for example, 15 for the cyan ink, 13 for the magenta ink and 13 for the yellow ink) to obtain the subtraction results (8 for the cyan ink, 9 for the magenta ink and 7 for the yellow ink) and a total residual amount of the all kinds of the ink (24) In the same manner as above, an amount of each ink predicted to be consumed to do printing of a printing object C (for example, 2 for the cyan ink, 5 for the magenta ink and 4 for the yellow ink) is subtracted from the amount of each ink predicted to be consumed to do printing of the printing object B (8 for the cyan ink, 9 for the magenta ink and 7 for the yellow ink) and the result of the subtraction (6 for the cyan ink, 4 for the magenta ink and 3 for the yellow ink) and a total residual amount of the all kinds of inks (13) are obtained and an amount of each ink predicted lo be consumed to do printing of a printing object D (for example, 8 for the cyan ink, 9 for the magenta ink and 7 for the yellow ink) is subtracted from the amount of each ink predicted to be consumed to do printing of the printing object C (6 for the cyan ink, 4 for the magenta ink and 3 for the yellow ink) and the result of the subtraction (−2 for the cyan ink, −5 for the magenta ink and −4 for the yellow ink) and a total residual amount of all kinds of the ink (−11; shown as "shortage") is obtained.

Next, the controlling section 38, based on the calculation results informed by the consumed amount comparing section 39, selects messages to be displayed on the display section 26 and instructs the display section 26 to display, together with the selected messages, an amount of each of the cyan, magenta and yellow ink predicted to be consumed to do printing of each of the printing objects, a residual amount of each of the cyan, magenta and yellow ink being left after having done printing of each of the printing objects, a sum of the residual amount of all kinds of the ink (a message "Shortage" in the case of the value of the total residual amount of the ink being negative), indications prompting for an instruction to perform processing of any one of printing, abortion of the printing, scheduling or a like. The controlling section 38 honors a request from the operator that operations of the operation section 27 are performed (Step SC3).

In the example, the controlling section 38, instructs the display section 26 to display, for example, messages "Not yet scheduled" and "Ink is not sufficient for printing object D, as shown in FIG. 11. Printing of printing object D and downward is not done", the amount of each ink predicted be consumed to do printing of the printing object A (5 for the cyan ink, 7 for the magenta ink and 7 for the yellow ink), a total residual amount of all kinds of the ink (41) for the printing object A, the amount of each ink predicted to be consumed to do printing of the printing object B (7 for the cyan ink, 4 for the magenta ink and 6 for the yellow ink), a result of the subtraction representing a residual amount of each ink being left after having printed the printing object B (8 for the cyan ink, 9 for the magenta ink and 7 for the yellow ink) and a total residual amount of all kinds of the ink (24) left after doing printing of the printing object B, the amount of each ink predicted be consumed to do printing of the printing object C (2 for the cyan ink, 5 for the magenta ink and 4 for the yellow ink), a result of the subtraction representing a residual amount of each ink left after having printed the printing object C (6 for the cyan ink, 4 for the magenta ink and 3 for the yellow ink) and a total residual amount of all kinds of the ink (13) left after doing printing of the printing object C and the amount of each ink predicted to be consumed to do printing of the printing object D (8 for the cyan ink, 9 for the magenta ink and 7 for the yellow ink), a result of the subtraction representing a residual amount of each ink being left after doing printing of the printing object D (−2 for the cyan ink, −5 for the magenta ink and −4 for the yellow ink) and the mewssage "Shortage". Moreover, the controlling section 38 instructs, for example, the keytops "PRINT", "SCHEDULING" and"CANCEL" to be displayed on the display section 26. Then, the controlling section 38 waits until the operator touches any one of the keytops "PRINT", "SCHEDULING" and "CANCEL" and a signal confirming the operator's touch is supplied from the operation section 27.

Next, the controlling section 38 judges whether an instruction for scheduling processing is provided by the operator, that is, whether a signal confirming the operator's touch of the keytop "SCHEDULING" is supplied from the operation section 27 (Step SC4). If judgement result is "YES", the controlling section 38 controls the scheduler 40 so that printing order for two or more kinds of printing objects is decided based on a predetermined algorithm and printing order is obtained (Step SC5). In the example, whether the combination "A, B, C and D" of the printing objects meets the conditions for being printed is checked. A sum of the amount of each ink predicted to be consumed to do printing of the combination "A, B, C and D" of the printing objects is 22 for the cyan ink, 25 for the magenta ink and 24 for the yellow ink and when a sum of a amount of each ink predicted to be consumed is subtracted from a residual amount of each ink (20 for the cyan ink, 20 for the magenta ink and 20 for the yellow ink), the difference is −2 for the cyan ink, −5 for the magenta ink and −4 for the yellow ink, which means that the example combination does not meet the above conditions. Next, a sum of an amount of each ink predicted to be consumed is calculated in all combinations composed of three printing objects making up the first group printing objects, "A, B and C", "A, B and D", "A, C and D" and "B, and C and D" and a difference between a residual amount of each ink and the total amount of each ink predicted to be consumed for each of the combinations is calculated. In the example, a total amount of each ink predicted to be consumed to do printing of the combination "A, B and C" of the printing objects is 14 for the cyan ink, 16 for the magenta ink and 17 for the yellow ink and when a sum of the amount of each ink predicted to be consumed is subtracted from a residual amount of each ink (20 for the cyan ink, 20 for the magenta ink and 20 for the yellow ink), the difference is 6 for the cyan ink, 4 for the magenta ink and 3 for the yellow ink. Similarly, a total amount of each ink predicted to be consumed to do printing of the combination "A, B and D" of the printing objects is 20 for the cyan ink, 20 for the magenta ink and 20 for the yellow ink and when the total amount of each ink predicted to be consumed is subtracted from the residual amount of each ink (20 for the cyan ink, 20 for the magenta ink and 20 for the yellow ink), the difference is 0 for the cyan ink, 0 for the magenta ink and 0 for the yellow ink. A total amount of each ink predicted to be consumed to do printing of the combination "A, C and D" of the printing objects is 15 for the cyan ink, 21 for the magenta ink and 18 for the yellow ink and when the total amount of each ink predicted to be consumed is subtracted from the residual amount of each ink (20 for the cyan ink, 20 for the magenta ink and 20 for the yellow ink), the difference is 5 for the cyan ink, −1 for the magenta ink and 2 for the yellow ink. A total amount of each ink predicted to be consumed to do printing of the combination "B, C and D" of the printing objects is 17 for the cyan ink, 18 for the magenta ink and 17 for the yellow ink and when the total amount of each ink predicted to be consumed is subtracted from the residual amount of each ink (20 for the cyan ink, 20 for the magenta ink and 20 for the yellow ink), the difference is 3 for the cyan ink, 2 for the magenta ink and 3 for the yellow ink. Since the combination that can meet the above conditions for being printed in these combinations is the combination "A, B and D", printing order "A, B and D" in which a higher priority is assigned to the combination "A, B and D" and a lower priority is assigned to the printing object "C" not contained in the combination "A, B and D", is selected as printing order for printing objects that should be employed after being scheduled. Since this causes the scheduler 40 to inform the printing order "A, B, D and C" as printing order that should be employed after being scheduled, the controlling section 38 obtains the printing order "A, B, D, C".

Next, the controlling section 38, based on the printing order of printing objects that should be employed after scheduling obtained from the scheduler 40, selects messages to be displayed on the display section 26 and instructs the display section 26 to display, together with the selected messages, an amount of each of the predicted to be consumed to do printing of each of the printing objects, a residual amount of each ink that is left after doing printing of each or the printing objects, the total residual amount of the ink (a message "Shortage" in the case of the value of the total residual amount of the ink being negative), indications prompting for instruction to perform processing of any one of printing, abortion of the printing, scheduling or the like. The controlling section 38 honors a request from the operator that operations of the operation section 27 are performed (Step SC6).

In the example, the controlling section 38, instructs the display section 26 to display as shown in FIG. 12, for example, messages "Already scheduled" and "Ink is not sufficient for printing object C. Printing of printing object C and downward is not done", the amount of each ink predicted to be consumed to do printing of the printing object A (5 for the cyan ink, 7 for the magenta ink and 7 for the yellow ink), a result of the subtraction expressing a residual amount of each ink left after having printed the printing object A (15 for the cyan ink, 13 for the magenta ink and 13 for the yellow ink), a total residual amount of all kinds of the ink (41) for the printing object A, the amount of each ink projected to be consumed to do printing of the printing object B (7 for the cyan ink, 4 for the magenta ink and 6 for the yellow ink), a result of the subtraction expressing a residual amount of each ink left after having printed the printing object B (8 for the cyan ink, 9 for the magenta ink and 7 for the yellow ink), a total residual amount of all kinds of the ink (24) for the printing object B, the amount of each ink predicted to be consumed to do printing of the printing object D (8 for the cyan ink, 9 for the magenta ink and 7 for the yellow ink), a result of the subtraction expressing a residual amount of each ink left after having printed the printing object D (0 for the cyan ink, 0 for the magenta ink and 0 for the yellow ink), a total residual amount of C (0) for the printing object D, the amount of each ink predicted to be consumed to do printing of the printing object C (2 for the cyan ink, 5 for the magenta ink and 4 for the yellow ink), a result of the subtraction expressing a residual amount of each ink left after having printed the printing object C (−2 for the cyan ink, −5 for the magenta ink and −4 for the yellow ink), and the message "Shortage". Moreover, the controlling section 38 instructs, for example, keytops "PRINT", "SCHEDULING" and "CANCEL" to be displayed on the display section 26. Then, the controlling section 38 waits until the operator touches any one of the keytops "PRINT", "SCHEDULING" or "CANCEL" and a signal confirming the operator's touch is supplied from the operation section 27.

On the other hand, a result of the judgement in Step SC4 is "NC", that is, if the operator does not touch the keytop "SCHEDULING" because the operator does not want the scheduling processing to be performed, the controlling section 38 does nothing. If the operator, by referencing the indications on the display section 26 as shown in FIG. 11, wants to print the printing objects A, B and C preferentially, and to print the printing object D after having replaced a cartridge, the operator will not indicate the top key indicator "SCHEDULING". In this case, the residual amount of each ink left after having printed the printing object C is 6 for the cyan ink, 4 for the magenta ink and 3 for the yellow ink and the total residual amount of all kinds of the ink is 13 and, at this point, the cartridge containing the residual amount of the ink is replaced without being totally consumed and, therefore, this does not lead to reduction in running costs.

Next, the controlling section 38 judges whether an instruction to do printing is provided from the operator, that is, whether the keytop "PRINT" is touched by the operator and a signal confirming the operator's touch, is supplied from the operation section 27 (Step SC7). If a result of the judgement is "YES", the controlling section 38 reads two or more pieces of printing data covering printing objects that can be printed normally without causing lacks of each ink in accordance with printing order originally instructed by the operator or in accordance with printing order for the printing object to be employed after scheduling which has been fed from the scheduler 40, from the extended printing data accumulating section 34 and feeds them to the printing unit 2 and instructs the printing unit 2 to do printing based on two or more pieces of printing data (Step SC8). Printing section 10 of the printing unit 2, based on two or more pieces of printing data to be supplied from the extended printing data accumulating section 34, sequentially prints the printing object on the printing medium by using each of the cyan, magenta and yellow ink. In the example, if no scheduling processing has been carried out, in accordance with printing order "A, B, C and D", the printing objects A, B and C are sequentially printed and, if scheduling processing has been carried out, in accordance with printing order "A, B, D and C", the printing objects A, B and D are sequentially printed.

Next, the controlling section 38 judges whether extended printing data that has not been printed is stored in the extended printing data accumulating section 34 or not (Step SC9). If a result of the judgement is "NO", the controlling section 38 terminates a series of the printing processes. This is a case where the residual amount of each ink exists in the printing unit 2 and the printing of all printing objects originally instructed by the operator has been completed. On the other hand, if a result of the judgement in Step SC9 is "YES", that is, when the extended printing data that has not been printed is stored in the extended printing data accumulating section 34, the controlling section 38 instructs the display section 26 to display a message prompting for replacing a cartridge "Ink is not sufficient. Replace the cartridge." (Step SC10). In the example, if the scheduling processing has not been carried out, since the printing object D has not been printed, extended printing data corresponding to the printing object D is not stored in the extended printing data accumulating section 34. If the scheduling processing has been carried out, since the printing object C has not been printed, extended printing data corresponding to the printing object C is stored in the extended printing data accumulating section 34.

Next, the controlling section 38 judges whether a cartridge of the printing unit 2 has been replaced by the operator within a predetermined time of period (Step SC11). If a result of the judgement in Step SC11 is "NO", a series of the printing processes is terminated. If a result of the judgement in Step SC11 is "YES", that is, when a cartridge of the printing unit 2 is replaced by the operator in a predetermined time of period, the controlling section 38 returns back to Step SC2 and repeats procedures in Step SC2 to SC10. In the example, if the scheduling processing has been carried out, the controlling section 38 controls the consumed amount comparing section 39 in Step SC2 to cause it to read an amount of each ink predicted to be consumed to do printing of the printing object C (2 for the cyan ink, 5 for the magenta ink and 4 for the yellow ink) from the extended printing data accumulating section 34 and to subtract the amount of each ink predicted to be consumed to do printing of the printing object C (2 for the cyan ink, 5 for the magenta ink and 4 for the yellow ink) from a residual amount of each ink contained in a new cartridge replaced in the printing unit (100 for the cyan ink, 100 for the magenta ink and 100 for the cyan ink) to obtain a result of the subtraction (98 for the cyan ink, 95 for the magenta ink and 96 for the yellow ink) and a sum of the residual amount of all kinds of the ink (289). Next, the controlling section 38, by processing in Step SC3 and based on a calculation result fed by the consumed amount comparing section 39, instructs the display section 26 to display messages "Not yet scheduled" and "All printing objects can be printed" as shown in FIG. 13, an amount of each ink predicted to be consumed to do printing of the printing object C (2 for the cyan ink, 5 for the magenta and 4 for the yellow ink), a residual amount of each ink left after having printed the printing object C (98 for the cyan ink, 95 for the magenta ink and 96 for the yellow ink), a sum of the residual amount of all kinds of the ink after having printed the printing object C (289), indication prompting for any one of processing of printing, abortion of the printing or scheduling processing or a like. Then, the controlling section 38 waits until the operator touches anyone of the keytops "PRINT", "SCHEDULING" or "CANCEL" and a signal confirming the operator's touch is supplied from the operation section 27.

Moreover, if a result of the judgement in Step SC7 is "NO", that is, when the operator touches the keytop "CANCEL" and a signal confirming the operator' touch is supplied from the operation section 27 and an instruction for aborting the printing is provided by the operator, the controlling section 38, after having performed processing required for aborting the printing including discarding of the extended printing data temporarily stored in the extended printing data accumulating section 34 (Step SC12), terminates a series of printing processes.

Other additional examples will be described below.

(1) Let it be assumed that the operator wants printing objects A, B, C, D and E to be printed, that a residual amount of each ink left in the printing unit 2 is 20 for cyan ink, 20 for magenta ink and 20 for yellow ink (values for each ink and downward are relative values) and that an amount of each ink predicted to be consumed to do printing of a printing object A is 5 for the cyan ink, 5 for the magenta ink and 5 for the yellow ink, en amount of each ink predicted to be consumed to do printing a printing object B is 10 for the cyan ink, 10 for the magenta ink and 10 for the yellow ink, an amount of each ink predicted to be consumed to do printing a printing object C is 2 for the cyan ink, 2 for the magenta ink and 2 for the yellow ink, an amount of each ink predicted to be consumed to do printing a printing object D is 6 for the cyan ink, 6 for the magenta ink and 6 for the yellow ink and an amount of each ink predicted to be consumed to do printing a printing object E is 4 for the cyan ink, 4 for the magenta ink and 4 for the yellow ink. In this example, if no scheduling is performed and the printing is done in the order of the printing objects A, B and C, since a residual amount of each ink is 3 for the cyan ink, 3 for the magenta ink and 3 for the yellow ink and a sum of the residual amount of all kinds of the ink is 9, it is impossible to do printing of the remaining printing objects D and E. However, if the scheduling is performed in accordance with the above printing conditions, printing order "A, B, E, C and D" is obtained. If the printing objects A, B and E are printed in accordance with the printing order "A, B, E, C and D", since a residual amount of each ink is 1 for the cyan ink, 1 for the magenta ink and 1 for the yellow ink and a sum of the residual amount of all kinds of the ink becomes 3, it is impossible to print the printing objects C and D. Thus, though three kinds of the printing objects can be printed in any case, the total residual amount left when the scheduling is performed is decreased to one-third of the total residual amount left when no scheduling is performed, allowing the ink to be efficiently used and running costs to be reduced.

(2) Let it be assumed that the operator wants printing objects A, B, C, D and E to be printed, that a residual amount of each ink left in the printing unit 2 is 20 for cyan ink, 20 for magenta ink and 20 for yellow ink (values for each ink and downward are relative values) and that an amount of each ink predicted to be consumed to do printing of a printing object A is 5 for the cyan ink, 5 for the magenta ink and 5 for the yellow ink, an amount of each ink predicted to be consumed to do printing a printing object B is 10 for the cyan ink, 10 for the magenta ink and 10 for the yellow ink, an amount of each ink predicted to be consumed to do printing a printing object C is 6 for the cyan ink, 4 for the magenta ink and 4 for the yellow ink, an amount of each ink predicted to be consumed to do printing a printing object D is 4 for the cyan ink, 6 for the magenta ink and 6 for the yellow ink and an amount of each ink predicted to be consumed to do printing a printing object E is 3 for the cyan ink, 4 for the magenta ink and 4 for the yellow ink. In this example, if no scheduling is performed and the printing objects A and B are printed in the order of printing objects A and B, since a residual amount of each ink is 5 for the cyan ink, 5 for the magenta ink and 5 for the yellow ink and a sum of the residual amount of each ink is 15, it is impossible to print the remaining printing objects C, D and E. Now, if a printing priority is assigned to the printing object that does not cause a factor for stopping the printing as in the case of the third conventional technology described above, the printing object E is to be printed preferentially and, if this printing is done, a residual amount of each ink is 2 for the cyan ink, 1 for the magenta ink and 1 for the yellow ink and a sum of the residual amount of all kinds of the ink becomes 4 and it is impossible to print the printing objects C and D. However, if the scheduling is performed in accordance with the printing conditions, printing order "A, C, D, E and B" is obtained. When the printing objects A, C, D and E are printed in accordance with printing order "A, C, D, E and B", since a residual amount of each ink is 2 for the cyan ink, 1 for the magenta ink and 1 for the yellow ink and a sum of the residual amount of all kinds of the ink becomes 4, it is impossible to print the printing object B. Thus, though the sum of the residual amount of each ink is 4 in any case, if the scheduling processing is performed in the example, four kinds of printing objects become able to be printed, allowing more printing objects to be printed.

Thus, according to the third embodiment, in addition to effects obtained in the first and second embodiments, other effects can be achieved; that is, since scheduling of the printing order is performed based on an amount of each ink predicted to be consumed to do printing of printing objects and on a residual amount of each ink and in accordance with printing conditions, the ink can be more efficiently used, running costs can be more reduced and more printing objects can be printed compared with the case of the third conventional technology in which contents of the printing object are not taken into consideration.

Moreover, according to the third embodiment, since extended printing data that has not been printed due to shortage of the ink can be stored in the extended printing data accumulating section 34 and, after replacement of the cartridge, scheduling can be again performed on two or more pieces of the extended printing data stored in the extended printing data accumulating section 34, the more the number or kind of printing objects that the operator wants to print is, the more efficiently the ink can be used and the more the running costs can be reduced.

It is apparent that the present invention is not limited to the above embodiments but may be changed and modified without departing from the scope and spirit of the invention. For example, in the above embodiments, the display section 4, operation panel sections 24 and 35, consumed amount calculating sections 8 and 37 and consumed amount comparing sections 9, 29 and 39 are mounted in the control units 1, 21 and 31, however, these parts may be mounted in the printing unit 2. Moreover, in the above first embodiment, if the display section 4, consumed amount calculating section 8 and consumed amount comparing section 9 are mounted in the printing unit 2, functions to control each part other than the printing data creation part in the printing data creating section 7 can be also mounted in the printing unit 2.

Also, in the above embodiments, an example in which only a part of the printing object of a same kind is printed is presented, however, two or more parts of the printing object of the same kind may be printed. In this case, an amount of each ink predicted to be consumed to do printing of two or more parts of the printing object of the same kind is obtained by multiplying an amount of each ink predicted to be consumed to do printing of one part of the printing object of the same kind by the number of parts making up the two or more parts of the printing object of the same kind intended to be printed.

Moreover, in the above second and third embodiments, the control units 22 and 33 and operation panel sections 24 and 35 are configured so as to operate individually and separately, however, the control units 22 and 33 may be constructed so that they have functions of the operation panel sections 24 and 35. Also, in the second and third embodiments, the operation panel sections 24 and 35 are configured so as to have relatively simple functions of displaying of messages, of scheduling processing or a like, however, they may be constructed so as to have various functions, that can provide conveniences to operators, of re-printing, providing messages with a voice, setting of algorithms for scheduling processing created by the operator or a like.

Also, in the third embodiment, the processing of the cartridge replacement is performed in Step SC10 and Step SC11, however, if printing of any one of the printing objects is found to be impossible due to a shortage of ink at a stage of processing in Step SC2 or of scheduling processing in Step SC5, a notification prompting for an instruction to replace a cartridge may be displayed in Step SC3 or SC6, instead of the indications shown in FIG. 11 or FIG. 12 or together with the indications shown in FIG. 11 or FIG. 12, and after the replacement of the cartridge is made, a subsequent processing and downward may be carried out.

Also, not only the cyan, magenta, yellow and black colors, but also other two or more colors may be used in the present inventions.

Also, in each of the embodiments, no special description of an interface between the control units 1, 21 and 31 and the printing unit 2 is provided, however, any one of interfaces having standards including centronics, RS-232C, SCSI (Small Computer System Interface) interface or a like may be employed.

Also, in each of the above embodiments, a case in which the printing unit 2 is an ink jet printer is presented, however, any one of printing units including a xerographic copying machine, facsimile, other type of printer, plotter or a like, so long as it can do printing of a printing object such as a document, image or a like on a printing medium such as paper, OHP film or a like, using printing agents including ink, toner or a like.

Furthermore, in each of the above embodiments, each of functions is configured by hardware, however, it can be configured by not only hardware but also software. That is, the control units 1, 21 and 31 may be so configured as to be composed of a CPU (Central Processing Unit), internal memories such as a ROM (Read Only Memory), RAM (Random Access Memory) or a like, external memories such as an FDD (Floppy Disk Drive), HDD (Hard Disk Drive), CD-ROM (Compact Disk-Read Only Memory) or a like and a computer having output and input devices, and the printing object creating sections 3 and 32, control sections 5, 22, 28, 33 and 38, consumed amount comparing sections 29 and 39 and the scheduler 40 may be so configured as to be composed of a CPU, wherein functions of the above printing object creating sections 3 and 32 are stored as an application program including word-processor software, graphics software or a like in a semiconductor memory such as the ROM and/or in storage media such as the FDD, HDD, CD-ROM or the like and wherein functions of the above control units 5, 22, 28, 33 and 38 and of the scheduler 40 are stored as printing control programs including a printer driver or a like in a semiconductor memory such as the ROM and/or in storage media such as the FDD, HDD, CD-ROM or the like. In this case, the above printing data accumulating section 6 and the extended printing data accumulating sections 23 and 34 serve as the internal memories or external memories and the application programs and printing control programs are read into the CPU from the storage media and are adapted to control operations of the CPU. The CPU, when the application programs and printing control programs start, functions as the printing object creating sections 3 and 32 and the control sections 5, 22, 28, 33 and 38, consumed amount comparing sections 29 and 39 and the scheduler 40 and carries out the above processing under control of the application programs and printing control programs.

What is claimed is:

1. A printing control method comprising:

a first step of creating, based on a printing object containing a document and/or an image, printing data composed of a character printing command providing an instruction for printing each of characters making up said document and/or a graphics drawing command providing an instruction for drawing a straight line and/or a curve making up said image and of calculating an amount of each of two or more kinds of printing agents each having a different color predicted to be consumed to do printing on a printing medium based on said printing data, and a second step of doing printing on said printing medium based on said printing data when a measured residual amount of each of said two or more kinds of said printing agents each having said different color is larger than an amount of each of said two or more kinds of said printing agents each having said different color predicted to be consumed to do printing and of providing, if said measured residual amount of each of said two or more kinds of said printing agents each having said different color is smaller than said amount of each of said two or more kinds of said printing agents each having said different color predicted to be consumed to do printing, a notification about this condition.

2. The printing control method according to claim 1, wherein, in said second step, after having provided said notification that said measured residual amount of each of said two or more kinds of said printing agents each having said different color is smaller than said amount of each of said two or more kinds of said printing agents each having said different color predicted to be consumed to do said printing, said created printing data is discarded.

3. A printing control method comprising:

a first step of creating, based on a printing object containing a document and/or an image, printing data composed of a character printing command providing an instruction for printing each of characters making up said document and/or a graphic drawing command providing an instruction for drawing a straight line and/or a curve making up said image and of calculating an amount of each of two or more kinds of printing agents each having said different color predicted to be consumed to do printing on a printing medium based on said printing data;

a second step of providing a notification about a measured residual amount of each of said two or more kinds of said printing agents each having said different color and a notification about an amount of each of said two or more kinds of said printing agents each having said different color predicted to be consumed to do printing, a notification prompting for an instruction to perform either of printing or abortion of printing, a notification about whether printing based on said printing data is possible or not and a notification about whether any of said two or more kinds of said printing agents each having said different color is not sufficient for printing; and third step of doing printing on said printing medium based on said printing data, when said instruction for printing is provided in response to said notification, irrespective of said residual amount of each of said two or more kinds of said printing agents each having said different color and of discarding said printing data and data on said amount of each of said two or more kinds of said printing agents each having said different color predicted to be consumed to do printing.

4. A printing control method comprising:

a first step of sequentially creating, based on two or more kinds of printing objects each containing a document and/or an image, two or more pieces of printing data composed of character printing commands each providing an instruction for printing each of characters making up said document and/or graphics drawing commands each providing an instruction for drawing a straight line and/or a curve making up said image and of sequentially calculating an amount of each of two or more kinds of printing agents each having a different color predicted to be consumed to do printing of said two or more kinds of said printing objects on a printing medium based on said two or more pieces of printing data;

a second step of providing a notification about an amount of each of said two or more kinds of said printing agents each having said different color predicted to be consumed to do said printing of said two or more kinds of said printing objects in accordance with a predetermined printing order, a notification about a residual amount of each of said two or more kinds of said printing agents each having said different color being left after having done said printing of each of said two or more kinds of said printing objects, said residual amount of which is obtained by sequentially subtracting, in accordance with said predetermined printing order, said amount of each of said two or more kinds of said printing agents each having said different color predicted to be consumed to do said printing of each of said two or more kinds of said printing objects, from said measured residual amount of each of said two or more kinds of said printing agents each having said different color, a notification promoting for an instruction to perform any one of printing, abortion of printing and scheduling for changing printing order for said two or more kinds of printing objects in accordance with a predetermined algorithm, a notification about whether said printing of all of said two or more kinds of said printing objects is possible or not and a notification about whether there is any said printing object that is unable to be printed due to shortage of any one of said two or more kinds of said printing agents each having said different color or not; and a third step of doing said printing, when said instruction to perform said printing is provided in response to said notification, on said printing medium based on printing data about a printing object, which is included in said two or more kinds of said printing objects, being able to be printed using said measured residual amount of each of said two or more kinds of said printing agents each having said different color, of discarding, when said instruction to abort said printing is provided in response to said notification, said printing data about said two or more kinds of said printing objects and data about said amount of each of said two or more kinds of said printing agents each having said different color predicted to be consumed to do said printing of each of said two or more kinds of said printing objects, of changing printing order for said two or more kinds of said printing objects, when said instruction to perform scheduling processing is provided in response to said notification, in accordance with said predetermined algorithm, and of notifying said amount of each of said two or more kinds of said printing agents each having said different color predicted to be consumed to do said printing of each of said two or more kinds of said printing objects in accordance with changed printing order and a residual amount of each of said two or more kinds of said printing agents each having said different color being left after having done said printing of each of said two or more kinds of said printing objects, said residual amount of which is obtained by sequentially subtracting, in accordance with said changed printing order, said amount of each of said two or more kinds of said printing agents each having said different color predicted to be consumed to do said printing of each of said two or more kinds of said printing objects, from said measured residual amount of each of said two or more kinds of said printing agents each having said different color, and of providing a notification prompting for said instruction to perform any one of said printing, said abortion of said printing and said scheduling processing, a notification about whether printing of all of said two or more kinds of said printing objects is possible or not and a notification about whether there is any kind of printing object that is unable to be printed due to shortage of any one of said two or more kinds of said printing agents each having said different color or not.

5. The printing control method according to claim 4, wherein, after having done said printing, if there is left any printing object that has not yet been printed, a notification prompting for an instruction to replace tanks or cartridges containing said two or more kinds of said printing agents each having said different color is provided and when, in response to said instruction, said tanks or said cartridges are replaced, said second step and downward is repeated.

6. The printing control method according to claim 4, wherein, in said second step, if said printing based on said printing data created from any of said two or more kinds of said printing objects is impossible by using said measured residual amount of each of said two or more kinds of said printing agents each having said different color, instead of said notification or together with said notification, a notification prompting for replacing said tanks or cartridges containing said two or more kinds of said printing agents each having said different color is provided.

7. The printing control method according to claim 4, wherein said predetermined algorithm includes a first process of selecting combined sets composed of said two or more kinds of said printing objects in various combinations, of calculating an amount of each of two or more kinds of printing agents each having a different color predicted to be consumed, of obtaining a difference between a residual amount of each of said two or more kinds of said printing agents each having said different color and a sum of said amount of each of said two or more kinds of said printing agents each having said different color predicted to be consumed and, if any combination out of said combinations meets conditions for being printed that a sum of said difference for each of said two or more kinds of said printing agents each having said different color is minimum and said difference for each of said two or more kinds of said printing agents each having said different color is more than 0 (zero), using said combination as printing order that should be employed after being scheduled, and a second process of selecting, if any combination selected out of all combinations composed of said two or more kinds of said printing objects does not meet said conditions, combined sets composed of printing objects a number of kinds of which is smaller by one than that of said two or more kinds of said printing objects, of calculating a sum of an amount of each of said two or more kinds of said printing agents each having said different color predicted to be consumed, of obtaining a difference between a residual amount of each of said two or more kinds of said printing agents each having said different color and said sum of an amount of each of said two or more kinds printing agents each having said different color predicted to be consumed for each of said combinations, and if any combination out of these combinations that can meet said conditions exists, of using printing order in which a high priority is assigned to said combination and a low priority is assigned to a printing object not contained in said combination as printing order that should be employed after being scheduled and wherein, if there is no combination that can meet said conditions out of all combinations prepared by said second step, combined sets composed of printing objects a number of kinds of which is further decreased by one are selected and same procedures that are taken in said second step are repeated.

8. A printing device comprising:

a consumed amount calculating section to calculate an amount of each of two or more kinds of printing agents each having a different color predicted to be consumed to do printing of a printing object on a printing medium based on printing data in synchronization with a printing data creating section, which is mounted in a control unit, to create, based on said printing object containing a document and/or an image, said printing data composed of a character printing command providing an instruction for printing each of characters making up said document and/or a graphic drawing command providing an instruction for drawing a straight line and/or a curve making up said image;

a printing section to do said printing on said printing medium based on said printing data by using said two or more kinds of said printing agents each having said different color;

a residual amount measuring section to measure a residual amount of each of said two or more kinds of said printing agents each having said different color existing in said printing section;

a consumed amount comparing section to compare said residual amount of each of said two or more kinds of said printing agents each having said different color with said amount of each of said two or more kinds of said printing agents each having said different color predicted to be consumed to do said printing; and a control section to control said printing section so as to do said printing based on said printing data if a result of comparison by said consumed amount comparing section shows that said residual amount of each of said two or more kinds of said printing agents each having said different color is not less than said amount of each of said two or more kinds of said printing agents each having said different color predicted to be consumed and to provide, if said result of comparison by said consumed amount comparing section shows that said residual amount of each of said two or more kinds of said printing agents each having said different color is less than said amount of each of said two or more kinds of said printing agents each having said different color predicted to be consumed, a notification about said comparison result.

9. The printing device according to claim 8, wherein said control section discards said printing data after having provided said notification about said comparison results.

10. A printing device comprising:

a consumed amount calculating section to calculate an amount of each of two or more kinds of printing agents each having a different color predicted to be consumed to do printing of a printing object on a printing medium based on printing data in synchronization with a printing data creating section, which is mounted in a control unit, to create, based on said printing object containing a document and/or an image, said printing data composed of a character printing command providing an instruction for printing each of characters making up said document and/or a graphic drawing command providing an instruction for drawing a straight line and/or a curve making up said image;

a printing section to do said printing on said printing medium based on said printing data by using said two or more kinds of printing agents each having a different color;

a residual amount measuring section to measure a residual amount of each of said two or more kinds of said printing agents each having said different color existing in said printing section;

a consumed amount comparing section to compare said residual amount of each of said two or more kinds of said printing agents each having a different color with said amount of each of said two or more kinds of said printing agents each having said different color predicted to be consumed to do said printing; and a control section to provide a notification about said residual amount of said each of two or more kinds of said printing agents each having said different color, a notification about said amount of said each of two or more kinds of said printing agents each having said different color predicted to be consumed to do said printing, a notification prompting for an instruction to perform either of said printing or abortion of said printing, a notification about whether said printing based on said printing data is possible or not based on a result of comparison by said consumed amount comparing section, a notification about whether any of said two or more kinds of said printing agents each having said different color is not sufficient for said printing, to control, if said instruction to perform said printing is provided in response to said notification, said printing section so as to do said printing on said printing medium based on said printing data, irrespective of said residual amount of each of said two or more kinds of said printing agents each having said different color, and to discard said printing data and data on said amount of each of said two or more kinds of said printing agents each having said different color predicted to be consumed, if said instruction to abort said printing is provided in response to said notification.

11. A printing device comprising:

a consumed amount calculating section to calculate an amount of each of two or more kinds of printing agents each having a different color predicted to be consumed to do printing of two or more kinds of printing objects on a printing medium based on two or more pieces of printing data in synchronization with a printing data creating section, which is mounted in a control unit, to sequentially create, based on said two or more kinds of said printing objects each containing a document and/or an image, said two or more pieces of printing data composed of character printing commands each providing an instruction for printing each of characters making up said document and graphics drawing commands each providing an instruction for drawing a straight line and/or a curve making up said image;

a printing section to do said printing of said two or more kinds of said printing objects on said printing medium based on said two or more pieces of printing data by using said two or more kinds of printing agents each having said different color;

a residual amount measuring section to measure a residual amount of each of said two or more kinds of said printing agents each having said different color existing in said printing section;

a consumed amount comparing section to compare said residual amount of each of said two or more kinds of said printing agents each having said different color with said amount of each of said two or more kinds of said printing agents each having said different color predicted to be consumed to do said printing of each of said two or more kinds of said printing objects; and a control section to provide a notification about said amount of each of said two or more kinds of printing agents each having said different color predicted to be consumed to do said printing of two or more kinds of printing objects in accordance with predetermined printing order and a notification about a residual amount of said each of two or more kinds of said printing agents each having said different color being left after having done said printing of each of said two or more kinds of said printing objects, said amount of which is obtained by sequentially subtracting, in accordance with said predetermined printing order, said amount of each of said two or more kinds of said printing agents each having said different color predicted to be consumed to do said printing of said two or more kinds of said printing objects, from said measured residual amount of each of said two or more kinds of printing agents each having said different color, to provide a notification prompting for an instruction to perform any one of printing, abortion of printing and scheduling for changing printing order for said two or more kinds of said printing objects in accordance with a predetermined algorithm, a notification about whether printing of all of said two or more kinds of said printing objects is possible or not and a notification about whether there is any kind of printing object that is unable to be printed due to shortage of any one of said two or more kinds of said printing agents or not, to do said printing, when said instruction to perform said printing is provided in response to said notification, on said printing medium based on printing data on said printing object, which is included in said two or more kinds of said printing objects, being able to be printed using said measured residual amount of each of said two or more kinds of said printing agents each having said different color, to discard, when said instruction to abort said printing is provided in response to said notification, said printing data about said two or more kinds of said printing objects and data about said amount of each of said two or more kinds of said printing agents each having said different color predicted to be consumed to do said printing of each of said two or more kinds of said printing objects, to change printing order for said two or more kinds of said printing objects, when said instruction to perform said scheduling processing is provided in response to said notification, in accordance with said predetermined algorithm, to notify said amount of each of said two or more kinds of said printing agents each having said different color predicted to be consumed to do said printing of each of said two or more kinds of said printing objects in accordance with said changed printing order and said residual amount of each of said two or more kinds of said printing agents each having said different color being left after having done printing of each of said two or more kinds of said printing objects, said residual amount of which is obtained by sequentially subtracting, in accordance with said chanced printing order, said amount of each of said two or more kinds of said printing agents each having said different color predicted to be consumed to do said printing of each of said two or more kinds of said printing objects, from said measured residual amount of each of said two or more kinds of said printing agents each having said different color, and to provide said notification prompting for said instruction to perform any one of said printing, said abortion of said printing and said scheduling processing, said notification about whether printing of all of said two or more kinds of said printing objects is possible or not and said notification about whether there is any said printing object that is unable to be printed due to said shortage of any one of said two or more kinds of said printing agents each having said different color or not.

12. The printing device according to claim 11, wherein said control section, if there is any said printing object that has not been printed even after said printing processing has been completed, provides a notification prompting for replacing tanks or cartridges containing said two or more kinds of said printing agents each having said different color and, when said tanks or cartridges are replaced, said processing is repeated.

13. The printing device according to claim 11, wherein said control section, if said printing based on said printing data created from any of said two or more kinds of said printing objects is impossible by using said measured residual amount of each of said two or more kinds of said printing agents each having said different color, instead of said notification or together with said notification, provides a notification prompting for replacing said tanks or said cartridges containing said two or more kinds of said printing agents each having said different color.

14. The printing device according to claim 11, wherein said predetermined algorithm includes a first process of selecting combined sets composed of said two or more kinds of said printing objects in various combinations, calculating said amount of each of said two or more kinds of said printing agents each having said different color predicted to be consumed, obtaining a difference between said residual amount of each of said two or more kinds of said printing agents each having said different color and a sum of said amount of each of said two or more kinds of said printing agents predicted to be consumed and, if any combination out of said combinations meets conditions for being printed that a sum of said difference for each of said two or more kinds of said printing agents each having said different color is minimum and said difference for each of said two or more kinds of said printing agents each having said different color is more than 0 (zero), using said combination as printing order that should be employed after being scheduled, and a second process of selecting, if any combination selected from said all combinations composed of said two or more kinds of said printing objects does not meet said conditions, combined sets composed of printing objects a number of kinds of which is smaller by one than that of said two or more kinds of said printing objects, of calculating a sum of an amount of each of said two or more kinds of said printing agents each having a different color predicted to be consumed, obtaining a difference between said residual amount of each of said two or more kinds of said printing agents each having said different color and said sum of said amount of each of said two or more kinds of said printing agents each having said different color predicted to be consumed for each of said combinations and, it any combination out of these said combinations that can meet said conditions exists, using printing order in which a high priority is assigned to said combination and a low priority is assigned to a printing object not contained in said combination as printing order that should be employed after being scheduled, and wherein, if there is no combination that can meet said conditions out of said all combinations obtained by said second step, combined sets composed of printing objects a number of kinds of which is further decreased by one are selected and same procedures that are taken In said second step are repeated.

15. A printing control device comprising:

a printing data creating section to create, based on a printing object containing a document and/or an image, said printing data composed of a character printing command providing an instruction for printing each of characters making up said document and/or a graphic drawing command providing an instruction for drawing a straight line and/or a curve making up said image;

a consumed amount calculating section to calculate, in synchronization with said printing data creating section, an amount of each of two or more kinds of printing agents each having a different color predicted to be consumed to do printing of said printing object on a printing medium based on printing data;

a printing section to do said printing of said printing object on said printing medium based on said printing data by using said two or more kinds of said printing agents each having said different color;

a residual amount measuring section to measure a residual amount of each of said two or more kinds of said printing agents each having said different color existing in said printing section;

a consumed amount comparing section to compare said residual amount of each of said two or more kinds of said printing agents each having said different color with said amount of each of said two or more kinds of said printing agents each having said different color predicted to be consumed; and a control section to control said printing section so as to do said printing based on said printing data if a result of comparison by said consumed amount comparing section shows that said residual amount of each of said two or more kinds of said printing agents each having said different color is not less than said amount of each of said two or more kinds of said printing agents each having said different color predicted to be consumed and to provide a notification, if said result of comparison by said consumed amount comparing section shows that said residual amount of each of said two or more kinds of said printing agents each having a different color is less than said amount of each of said two or more kinds of said printing agents each having said different color predicted to be consumed, about said comparison result.

16. The printing control device according to claim 15, wherein said control section discards said printing data after providing said notification about said comparison results.

17. A printing control device comprising:

a printing data creating section to create, based on a printing object containing a document and/or an image, said printing data composed of a character printing command providing an instruction for printing each of characters making up said document and/or a graphic drawing command providing an instruction for drawing a straight line and/or a curve making up said image;

a consumed amount calculating section to calculate, in synchronization with said printing data creating section, an amount of each of two or more kinds of printing agents each having a different color predicted to be consumed to do printing of a printing object on a printing medium based on printing data;

a printing section to do printing of said printing object on said printing medium based on said printing data by using said two or more kinds of said printing agents each having said different color;

a residual amount measuring section to measure a residual amount of each of said two or more kinds of said printing agents each having said different color existing in said printing section;

a consumed amount comparing section to compare said residual amount of each of said two or more kinds of said printing agents each having said different color with said amount of each of said two or more kinds of said printing agents each having said different color predicted to be consumed; and a control section to provide a notification about said residual amount of each of said two or more kinds of said printing agents each having said different color, a notification about said amount of each of said two or more kinds of printing agents each having said different color predicted to be consumed, a notification prompting for an instruction to perform either of said printing or abortion of said printing, a notification about whether said printing based on said printing data is possible or not based on a result of comparison of said consumed amount comparing section, a notification about whether any of said two or more kinds of said printing agents each having said different color is not sufficient for printing, and to control, if said instruction to perform said printing is provided in response to said notification, said printing section so as to do said printing on said printing medium based on said printing data, irrespective of said residual amount of each of said two or more kinds of said printing agents each having said different color, and to discard said printing data and data on said amount of each of said two or more kinds of said printing agents each having said different color predicted to be consumed, if said instruction to abort said printing is provided in response to said notification.

18. A printing control device comprising:

a printing data creating section to create, based on two or more kinds of said printing objects each containing a document and/or an image, sequentially two or more pieces of printing data composed of a character printing command providing an instruction for printing each of characters making up said document and/or a graphic drawing command providing an instruction for drawing a straight line and/or a curve making up said image;

a consumed amount calculating section to calculate, in synchronization with said printing data creating section, an amount of each of two or more kinds of printing agents each having a different color predicted to be consumed to do printing of two or more kinds of printing objects on a printing medium based on said two or more pieces of printing data;

a printing section to do said printing of said two or more kinds of said printing objects on said printing medium based on said two or more pieces of printing data by using said two or more kinds of printing agents each having said different color;

a residual amount measuring section to measure a residual amount of each of said two or more kinds of said printing agents each having said different color existing in said printing section;

a consumed amount comparing section to compare said residual amount of each of said two or more kinds of said printing agents each having said different color with said amount of each of said two or more kinds of said printing agents each having said different color predicted to be consumed to do said printing of each of said two or more kinds of said printing objects; and a control section to provide a notification about said amount of each of said two or more kinds of said printing agents each having said different color predicted to be consumed to do printing of two or more kinds of printing objects in accordance with a predetermined printing order and a notification about said residual amount of each of said two or more kinds of printing agents each having said different color being left after having done said printing of each of said two or more finds of said printing objects, said amount of which is obtained by sequentially subtracting, in accordance with said predetermined printing order, said amount of each of two or more kinds of printing agents each having said different color predicted to be consumed to do printing of said two or more kinds of said printing objects, from said measured residual amount of each of said two or more kinds of printing agents each having said different color, to provide a notification prompting for an instruction to perform any one of printing, abortion of printing and scheduling for changing printing order for said two or more kinds of said printing objects in accordance with a predetermined algorithm, a notification about whether said printing of all of said two or more kinds of said printing objects is possible or not and a notification about whether there is any said printing object that is unable to be printed due to shortage of any one of said two or more kinds of said printing agents each having said different color or not, to do printing, when said instruction to perform said printing is provided in response to said notification, on said printing medium based on printing data about a printing object, which is included in said two or more kinds of said printing objects, being able to be printed using said measured residual amount of each of said two or more kinds of said printing agents each having said different color, to discard, when said instruction to abort said printing is provided in response to said notification, said printing data about said two or more kinds of said printing objects and data on said amount of each of said two or more kinds of said printing agents each having said different color predicted to be consumed to do said printing of each of said two or more kinds of said kinds of printing objects, to charge printing order for said two or more kinds of said printing objects, when said instruction to perform scheduling processing is provided in response to said notification, in accordance with said predetermined algorithm, to notify said amount of each of said two or more kinds of said printing agents each having said different color predicted to be consumed to do printing of each of said two or more kinds printing objects in accordance with changed printing order and said residual amount of each of said two or more kinds of said printing agents each having said different color being left after having done said printing of each of said two or more kinds of said printing objects, said residual amount of which is obtained by sequentially subtracting, in accordance with said changed printing order, said amount of each of said two or more kinds of said printing agents each having said different color predicted to be consumed to do said printing of each of said two or more kinds of said printing objects, from said measured residual amount of each of said two or more kinds of said printing agents each having said different color, and to provide a notification prompting for said instruction to perform any one of said printing, said abortion of said printing and said scheduling processing, a notification about whether said printing of all of said two or more kinds of said printing objects is possible or not and a notification about whether there is any printing object that is unable to be printed due to shortage of any one of said two or more kinds of said printing agents each having said different color or not.

19. The printing control device according to claim 18, wherein said control section, if there is any said printing object that has not been printed even after said printing processing has been completed, provides a notification prompting for replacing tanks or cartridges containing two or more kinds of printing agents each having said different color and when said tanks or said cartridges are replaced, said processing is repeated.

20. The printing control device according to claim 18, wherein said control section, if said printing based on said printing data created from any of said two or more kinds of said printing objects is impossible by using said measured residual amount of each of said two or more kinds of said printing agents each having said different color, instead of said notification or together with said notification, provides a notification prompting for replacing said tanks or cartridges containing said two or more kinds of said printing agents each having said different color.

21. The printing control device according to claim 18, wherein said predetermined algorithm includes a first process of selecting combined sets composed of said two or more kinds of said printing objects in various combinations, calculating said amount of each of said two or more kinds of said printing agents each having said different color predicted to be consumed, obtaining a difference between said residual amount of each of said printing agents each having said different color and a sum of said amount of each of said two or more kinds of said printing agents each having said different color predicted to be consumed and, if any combination out of said combinations meets conditions for being printed that a sum of said difference for each of said two or more kinds of said printing agents each having said different color is minimum and said difference for each of said two or more kinds of said printing agents each having said different color is more than 0 (zero), using said combination as printing order that should be employed after being scheduled, and a second process of selecting, if any combination selected from all combinations composed of said two or more kinds of said printing objects does not meet said conditions, combined sets composed of printing objects a number of kinds of which is smaller by one than that of said two or more kinds of said printing objects, of calculating a sum of an amount of each of said two or more kinds of said printing agents each having said different color predicted to be consumed, of obtaining a difference between said residual amount of each of said two or more kinds of said printing agents each having said different color and said sum of an amount of each of said two or more kinds of said printing agents each having said different color predicted to be consumed for each of said combinations, and if any combination out of these said combinations that can meet said conditions exists, of using printing order in which a high priority is assigned to said combination and a low priority is assigned to a printing object not contained in said combination as printing order that should be employed after being scheduled, and wherein, if there is no combination that can meet said conditions out of said all combinations obtained by said second step, combined sets composed of printing objects a number of kinds of which is further decreased by one are selected and same procedures that are taken in said second step are repeated.

22. A storage medium storing a printing control program to cause a computer to carry out a printing control method comprising:

a first step of creating, based on a printing object containing a document and/or an image, printing data composed of a character printing command providing an instruction for printing each of characters making up said document and/or a graphics drawing command providing an instruction for drawing a straight line and/or a curve making up said image and of calculating an amount of each of two or more kinds of printing agents each having a different color predicted to be consumed to do printing on a printing medium based on said printing data; and a second step of doing printing on said printing medium based on said printing data when a measured residual amount of each of said two or more kinds of said printing agents each having said different color is larger than an amount of each of said two or more kinds of said printing agents each having said different color predicted to be consumed to do printing and of providing, if said measured residual amount of each of said two or more kinds of said printing agents each having said different color is smaller than said amount of each of said two or more kinds of said printing agents each having said different color predicted to be consumed to do printing, a notification about this condition.

23. A storage medium storing a printing control program to cause a computer to carry out a printing control method comprising:

a first step of creating, based on a printing object containing a document and/or an image, printing data composed of a character printing command providing an instruction for printing each of characters making up said document and/or a graphic drawing command providing an instruction for drawing a straight line and/or a curve making up said image and of calculating an amount of each of two or more kinds of printing agents each having said different color predicted to be consumed to do printing on a printing medium based on said printing data;

a second step of providing a notification about a measured residual amount of each of said two or more kinds of said printing agents each having said different color and a notification about an amount of each of said two or more kinds of said printing agents each having said different color predicted to be consumed to do printing, a notification prompting for an instruction to perform either of printing or abortion of printing, a notification about whether printing based on said printing data is possible or not and a notification about whether any of said two or more kinds of said printing agents each having said different color is not sufficient for printing; and a third step of doing printing on said printing medium based on said printing data, when said instruction for printing is provided in response to said notification, irrespective of said residual amount of each of said two or more kinds of said printing agents each having said different color and of discarding said printing data and data on said amount of each of said two or more kinds of said printing agents each having said different color predicted to be consumed to do printing.

24. A storage medium storing a printing control program to cause a computer to carry out a printing control method comprising:

a first step of sequentially creating, based on two or more kinds of printing objects each containing a document and/or an image, two or more pieces of printing data composed of character printing commands each providing an instruction for printing each of characters making up said document and/or graphics drawing commands each providing an instruction for drawing a straight line and/or a curve making up said image and of sequentially calculating an amount of each of two or more kinds of printing agents each having a different color predicted to be consumed to do printing of said two or more kinds of said printing objects on a printing medium based on said two or more pieces of printing data;

a second step of providing a notification about an amount of each of said two or more kinds of said printing agents each having said different color predicted to be consumed to do said printing of said two or more kinds of said printing objects in accordance with a predetermined printing order, a notification about a residual amount of each of said two or more kinds of said printing agents each having said different color being left after having done said printing of each of said two or more kinds of said printing objects, said residual amount of which is obtained by sequentially subtracting, in accordance with said predetermined printing order, said amount of each of said two or more kinds of said printing agents each having said different color predicted to be consumed to do said printing of each of said two or more kinds of said printing objects, from said measured residual amount of each of said two or more kinds of said printing agents each having said different color, a notification prompting for an instruction to perform any one of printing, abortion of printing and scheduling for changing printing order for said two or more kinds of printing objects in accordance with a predetermined algorithm, a notification about whether said printing of all of said two or more kinds of said printing objects is possible or not and a notification about whether there is any said printing object that is unable to be printed due to shortage of any one of said two or more kinds of said printing agents each having said different color or not; and a third step of doing said printing, when said instruction to perform said printing is provided in response to said notification, on said printing medium based on printing data about a printing object, which is included in said two or more kinds of said printing objects, being able to be printed using said measured residual amount of each of said two or more kinds of said printing agents each having said different color, of discarding, when said instruction to abort said printing is provided in response to said notification, said printing data about said two or more kinds of said printing objects and data about said amount of each of said two or more kinds of said printing agents each having said different color predicted to be consumed to do said printing of each of said two or more kinds of said printing objects, of changing printing order for said two or more kinds of said printing objects, when said instruction to perform scheduling processing is provided in response to said notification, in accordance with said predetermined algorithm, and of notifying said amount of each of said two or more kinds of said printing agents each having said different color predicted to be consumed to do said printing of each of said two or more kinds of said printing objects in accordance with changed printing order and a residual amount of each of said two or more kinds of said printing agents each having said different color being left after having done said printing of each of said two or more kinds of said printing objects, said residual amount of which is obtained by sequentially subtracting, in accordance with said changed printing order, said amount of each of said two or more kinds of said printing agents each having said different color predicted to be consumed to do said printing of each of said two or more kinds of said printing objects, from said measured residual amount of each of said two or more kinds of said printing agents each having said different color, and of providing a notification prompting for said instruction to perform any one of said printing, said abortion of said printing and said scheduling processing, a notification about whether printing of all of said two or more kinds of said printing objects is possible or not and a notification about whether there is any kind of printing object that is unable to be printed due to shortage of any one of said two or more kinds of said printing agents each having said different color or not.

* * * * *